US007690768B2

(12) United States Patent
Eguchi et al.

(10) Patent No.: US 7,690,768 B2
(45) Date of Patent: Apr. 6, 2010

(54) LIQUID EJECTING HEAD AND LIQUID EJECTING APPARATUS

(75) Inventors: Takeo Eguchi, Kanagawa (JP); Shogo Ono, Kanagawa (JP); Takaaki Miyamoto, Kanagawa (JP); Kazuyasu Takenaka, Tokyo (JP)

(73) Assignee: Sony Corporation, Tokyo (JP)

( * ) Notice: Subject to any disclaimer, the term of this patent is extended or adjusted under 35 U.S.C. 154(b) by 452 days.

(21) Appl. No.: 11/699,715

(22) Filed: Jan. 30, 2007

(65) Prior Publication Data

US 2007/0188561 A1 Aug. 16, 2007

(30) Foreign Application Priority Data

Feb. 2, 2006 (JP) ..... 2006-025496

(51) Int. Cl.
*B41J 2/05* (2006.01)

(52) U.S. Cl. ..... 347/56

(58) Field of Classification Search ..... 347/20, 347/47, 54, 56, 65

See application file for complete search history.

(56) References Cited

U.S. PATENT DOCUMENTS

| | | | | |
|---|---|---|---|---|
| 5,208,605 | A * | 5/1993 | Drake | 347/15 |
| 6,520,626 | B1 * | 2/2003 | Murakami | 347/56 |
| 2002/0039123 | A1 | 4/2002 | Lee et al. | |
| 2004/0125175 | A1 | 7/2004 | Yang et al. | |

FOREIGN PATENT DOCUMENTS

| | | | |
|---|---|---|---|
| EP | 1356938 | A2 * | 10/2003 |
| EP | 1 570 992 | A2 | 9/2005 |
| EP | 1 634 708 | A2 | 3/2006 |
| EP | 1 705 013 | A1 | 9/2006 |
| JP | 2003-136737 | | 5/2003 |

* cited by examiner

*Primary Examiner*—An H Do
(74) *Attorney, Agent, or Firm*—Robert J. Depke; Rockey, Depke & Lyons, LLC

(57) ABSTRACT

A liquid ejecting head includes a plurality of liquid ejecting portions arrayed in a flat region on a substrate. The liquid ejecting portions each include a liquid chamber that accommodates liquid to be ejected, a heater element arranged in the liquid chamber, the heater element generating bubbles in liquid in the liquid chamber when heated, and a nozzle for ejecting liquid in the liquid chamber in accordance with generation of bubbles by the heater element.

8 Claims, 15 Drawing Sheets

JAPANESE PATENT APPLICATION NO. 2003-383232

THROUGH-HOLE PROVIDED

BASIC FORM OF THIS EMBODIMENT

LIQUID EJECTING HEAD AND LIQUID EJECTING APPARATUS

CROSS REFERENCE TO RELATED APPLICATION

The present invention contains subject matter related to Japanese Patent Application JP 2006-025496 filed in the Japanese Patent Office on Feb. 2, 2006, the entire contents of which are incorporated herein by reference.

BACKGROUND OF THE INVENTION

1. Field of the Invention

The present invention relates to an ink ejecting head of a thermal system for use in an inkjet printer head or the like, and an ink ejecting apparatus such as an inkjet printer including the ink ejecting head. More specifically, the present invention relates to a technique for realizing a liquid supply structure with little ejection non-uniformity.

2. Description of the Related Art

As an example of liquid ejecting heads for use in a liquid ejecting apparatus such as an inkjet printer, there is known a thermal system that utilizes the expansion and contraction of generated bubbles.

In such a thermal system, heater elements are provided on a semiconductor substrate, bubbles are generated in the liquid inside a liquid chamber by these heater elements, and liquid is ejected in the form of droplets from nozzles arranged on the heater elements to be impacted on a recording medium or the like.

FIG. 13 is a perspective exterior view showing a liquid ejecting head 1 (hereinafter, simply referred to as "head 1") of this type according to the related art. In FIG. 13, a nozzle sheet 17, which is provided on a barrier layer 3, is shown in an exploded state.

FIG. 14 is a sectional view showing the channel structure of the head 1 shown in FIG. 1. It should be noted that a channel structure of this type employed in a liquid ejecting apparatus is disclosed in, for example, Japanese Unexamined Patent Application Publication No. 2003-136737.

In FIGS. 13 and 14, a plurality of heater elements 12 are arranged on a semiconductor substrate 11. Further, the barrier layer 3 and the nozzle sheet (nozzle layer) 17 are laminated in order on the semiconductor substrate 11. Herein, an assembly in which the heater elements 12 are formed on the semiconductor substrate 11, with the barrier 3 being formed above the heater elements 12, is referred to as a head chip 1*a*. Further, an assembly with nozzles 18 (nozzle sheet 17) formed on the head chip 1*a* is referred to as the head 1.

The nozzle sheet 17 has the nozzles 18 arranged such that the nozzles (holes for ejecting droplets) 18 are located on the respective heater elements 12. Further, the barrier layer 3 provided on the semiconductor substrate 11 is interposed between the heater elements 12 and the nozzles 18, thus forming liquid chambers 3*a* between the portion above the heater elements 12 and the nozzles 18.

As shown in FIG. 13, the barrier layer 3 is formed in a substantially comb-tooth like configuration so as to surround three sides of each heater element 12, thereby forming the liquid chamber 3*a* of which only one side is open. This opening portion forms an individual channel 3*d*, which communicates with a common channel 23.

Further, the heater elements 12 are arrayed in proximity to one side of the semiconductor substrate 11. Further, in FIG. 14, a dummy chip D is arranged on the left side of the semiconductor substrate 11 (head chip 1a), so the common channel 23 is formed by one side surface of the semiconductor substrate 11 (head chip 1*a*) and one side surface of the dummy chip D. It should be noted that any kind of member may be used instead of the dummy chip D as long as the common channel 23 can be formed.

Further, as shown in FIG. 14, a channel plate 22 is arranged on the surface of the semiconductor substrate 11 opposite to the surface on which the heater elements 12 are provided. As shown in FIG. 14, an ink supply port 22*a* and a supply channel (common channel) 24, which is substantially recessed in cross section so as to communicate with the ink supply port 22*a*, are formed in the channel plate 22. The supply channel 24 and the common channel 23 communicate with each other.

Accordingly, ink is fed from the ink supply port 22*a* to the supply channel 24 and the common channel 23, and passes through the individual channel 3*d* to enter the liquid chamber 3*a*. Then, as the heater element 12 is heated, bubbles are generated on the heater element 12 inside the liquid chamber 3*a*. The flight force exerted at the time of this bubble generation causes a part of the liquid in the liquid chamber 3*a* to be ejected in the form of (ink) droplets from the nozzle 18.

It should be noted that in FIGS. 13 and 14, for the ease of understanding, the actual configurations are ignored, and the configurations are depicted in an exaggerated manner. For instance, the thickness of the semiconductor substrate 11 is about 600 to 650 μm, and the thickness of the nozzle sheet 17 or barrier layer 3 is about 10 to 20 μm.

Further, examples of the method of manufacturing the above-mentioned head 1 include a first (chip mount) method in which the head chip 1*a* manufactured through the semiconductor process is bonded onto the nozzle sheet 17 manufactured through a separate process, and a second method (on chip nozzle: OCN) in which the portion of the nozzles 18 is also formed integrally on the semiconductor substrate 11.

SUMMARY OF THE INVENTION

When manufacturing the above-described head 1 according to the related art by the first method, in particular, the head chip 1*a* and the nozzle sheet 17 are separately manufactured independently from each other, and then positional alignment or adhesion process on a micron scale is performed, followed by the accompanying heating and pressurizing steps. Hence, extremely sophisticated manufacturing control is required. In the case where a plurality of head chips 1*a* are arranged side by side on the nozzle sheet 17 to form a line head corresponding to the width of the recording medium, in particular, slight changes during manufacture may cause a difference in performance on a per each head chip 1*a* basis, which in turn may manifest itself as image quality degradation.

In this connection, a head chip is known in which a through-hole used for ink supply is provided at the central portion of the head chip so as to extend along the longitudinal direction of the head chip, and heater elements, liquid chambers, and nozzles are arrayed along the through-hole on both sides of the through hole.

It is an empirically established fact that in the case of a head having the structure as described above, a variation in characteristics between head chips due to chip mount can be mitigated in comparison to a head in which, as in the head 1 shown in FIGS. 13 and 14, the heater elements 12 and the like are arrayed at the end of the semiconductor substrate 11.

However, the above-mentioned structure involves the following problems.

(1) The size of the head chip structure becomes about twice as large with respect to the width direction.

(2) It is necessary to introduce a special semiconductor process in order to form the through-hole at the central portion of the head chip.

(3) An increase in cost, and a decrease in yield occur.

When manufacturing the head by the above-described second method, the problem of a variation in characteristics due to chip mount does not occur. However, when forming the line head, problems still remain such as the technique for fixing a large number of head chips onto a large frame, the necessity of securing the accuracy of the joining between head chips, and the difficulty of uniformly supplying liquid to all the head chips. Hence, the adoption of the second method does not solve the problems associated with the line head manufacture.

In view of this, it is desirable to provide a channel structure which reduces a variation in characteristics between head chips resulting from a variation in manufacture, and reduces the probability of bubble generation to an extremely low level.

The present invention addresses the above-mentioned problems by the following means.

According to an embodiment of the present invention, there is provided a liquid ejecting head including a plurality of liquid ejecting portions arrayed in a flat region on a substrate, the liquid ejecting portions each including: a liquid chamber that accommodates liquid to be ejected; a heater element arranged in the liquid chamber, the heater element generating bubbles in liquid in the liquid chamber when heated; and a nozzle for ejecting liquid in the liquid chamber in accordance with generation of bubbles by the heater element. Of a plurality of the heater elements, the center of the heater element located at the M-th position (M is either an odd number or even number) as counted from one end side is arranged on a straight line L1, which extends along an array direction of the heater element, or in its vicinity, and the center of the heater element located at the N-th position (N is an even number when the M is an odd number, and N is an odd number when the M is an even number) as counted from the one end side is arranged on a straight line L2 or in its vicinity, the straight line L2 being parallel to the straight line L1 and spaced at an interval δ (δ is a real number larger than 0) from the straight line L1. The liquid chamber is formed in a substantially recessed configuration in plan view so as to surround three sides of the heater element. A plurality of the heater elements are arrayed at a constant pitch P in the directions of the straight line L1 and the straight line L2. The liquid chamber that surrounds the heater element arranged on the straight line L1 or in its vicinity, and the liquid chamber that surrounds the heater element arranged on the straight line L2 or in its vicinity are arranged so that their opening portions are opposed to each other. A gap Wx (Wx is a real number larger than 0) is formed at least one of between the liquid chambers that are arrayed on the straight line L1 or in its vicinity and spaced from each other by a distance 2P, and between the liquid chambers that are arrayed on the straight line L2 or in its vicinity and spaced from each other by the distance 2P, with respect to an array direction of the liquid chamber. A gap Wy (Wy is a real number larger than 0, where Wy>Wx) is formed between the liquid chamber arrayed on the straight line L1 or in its vicinity, and the liquid chamber arrayed on the straight line L2 or in its vicinity, with respect to a direction perpendicular to the array direction of the liquid chamber. A liquid channel having a width equal to the gap Wx, and a liquid channel having a width equal to the gap Wy are formed by the gap Wx and the gap Wy, respectively.

According to the embodiment of the present invention mentioned above, the liquid ejecting portions are arrayed in the extending directions of the straight lines L1 and L2. Further, the straight lines L1 and L2 are arranged at an interval δ from each other. Further, the center of the heater element at the M-th position as counted from one end side is arranged on the straight line L1 or in its vicinity, and the center of the heater element at the N-th position as counted from one end side is arranged on the straight line L2 or in its vicinity.

Furthermore, the liquid chamber arranged on the straight line L1 and in its vicinity and the liquid chamber arranged on the straight line L2 and in its vicinity are arranged so that their opening portions are opposed to each other. Further, the gap Wy formed between the liquid chamber arranged on the straight line L1 and in its vicinity and the liquid chamber arranged on the straight line L2 and in its vicinity forms the channel having a width equal to the gap Wy (corresponding to a second common channel 23*b* in the description of embodiments that follows). On the other hand, the gap Wx (here, Wx<Wy) formed between the liquid chambers located on at least one of the straight line L1 and the straight line L2 or in its vicinity forms the channel having a width equal to the gap Wx (corresponding to a first common channel 23*a* in the description of embodiments that follows)

According to the embodiment of the present invention, liquid is supplied uniformly to each liquid chamber. Further, the ejection speed can be made uniform, thereby making it possible to reduce a variation in ejection characteristics between the liquid ejecting portions. Furthermore, since the supply of liquid to each liquid chamber is facilitated, the occurrence of bubble trouble is suppressed, and even when bubble trouble does occur, self-reset is readily performed.

DESCRIPTION OF THE PREFERRED EMBODIMENTS

Figure 1:
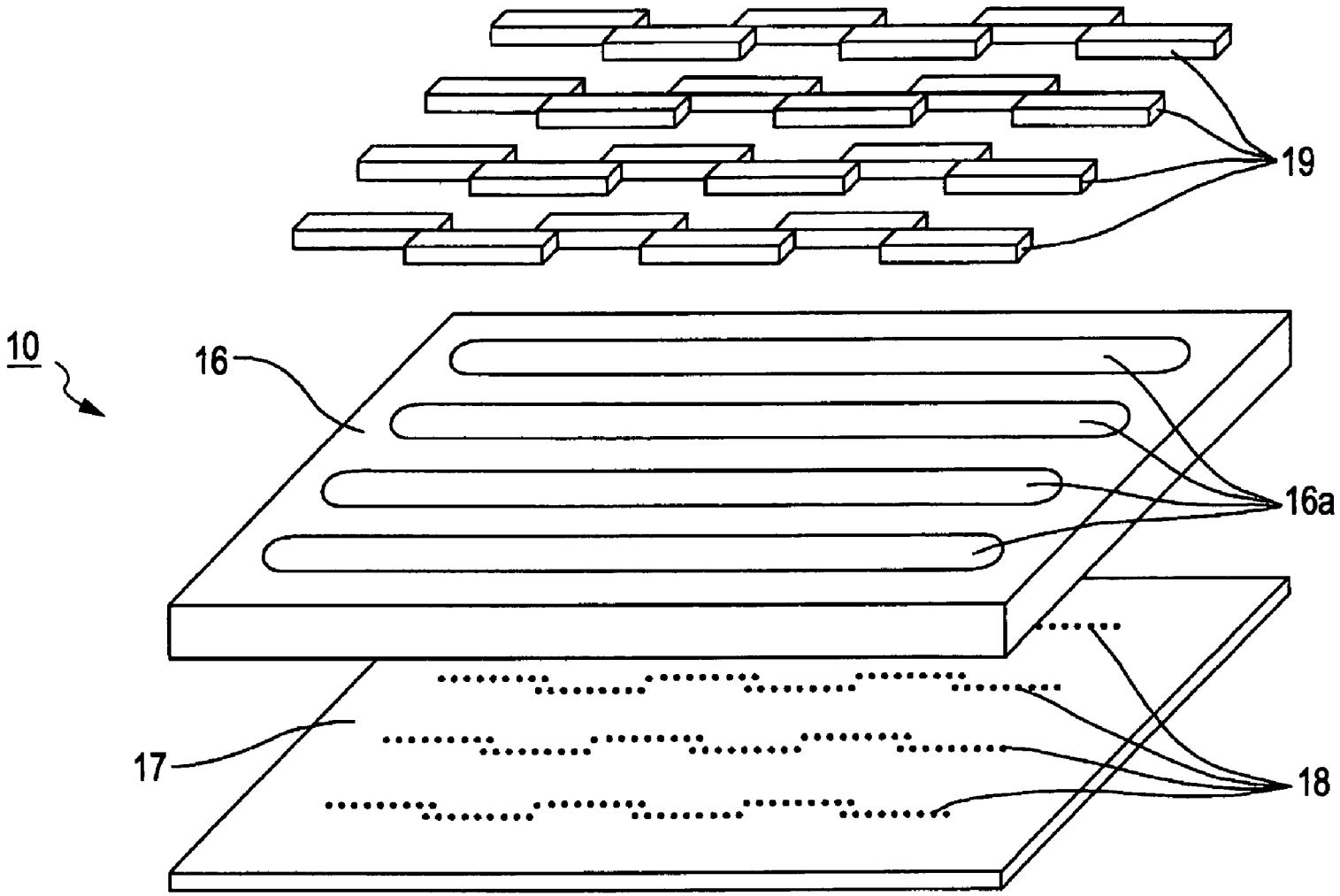
FIG. 1 is a perspective exterior view showing a line head according to an embodiment of the present invention.

An embodiment of the present invention will now be described with reference to the drawings and the like.

In this embodiment, a liquid ejecting apparatus according to the present invention is an inkjet printer (thermal type color line printer: hereinafter simply referred to as the "printer"), and a liquid ejecting head is a line head 10.

It should be noted that in this specification, the portion including one liquid chamber 13*a*, a heater element 12 (in this embodiment, in particular, one that is split in two as will be described later) arranged inside that liquid chamber 13*a*, and a nozzle 18 is referred to as the "liquid ejecting portion". That is, the line head 10 (liquid ejecting head) refers to a plurality of arrays of liquid ejecting portions. Furthermore, a head chip 19 provided with nozzles 18 (nozzle sheet 17) is referred to as the "liquid ejecting head".

FIG. 1 is a perspective exterior view showing the line head 10 according to this embodiment. The line head 10 is formed as a four-color head by arranging side by side four head chip 19 rows each having head chips 19 arranged side by side in a line corresponding to the width of an A4-size recording medium, the respective head chip 19 rows corresponding to Y (yellow), M (magenta), C (cyan), and K (black).

Further, the line head 10 is formed by arranging a plurality of head chips 19 side by side in a staggered fashion and bonding the lower portions of these head chips 19 onto a single nozzle sheet 17 (nozzle layer). Here, the respective nozzles 18 formed in the nozzle sheet 17, and the respective heater elements 12 formed in the head chips 19 are arranged in correspondence with each other.

A head frame 16 is a support member for supporting the nozzle sheet 17, and has a size corresponding to the nozzle sheet 17. Further, the length of each accommodating space 16*a* is set in conformity with the lateral width of size A4 (about 21 cm).

Each one of the four head chip 19 rows is arranged inside each accommodating space 16*a* of the head frame 16. Further, ink tanks accommodating different colors of liquid (ink) are each mounted on the back surface of the head chip 19 and in the accommodating space 16*a* of the head frame 16 for each one of the rows. Liquids of different colors are thus supplied to the respective accommodating spaces 16*a*, that is, the respective head chip 19 rows.

Figure 2:
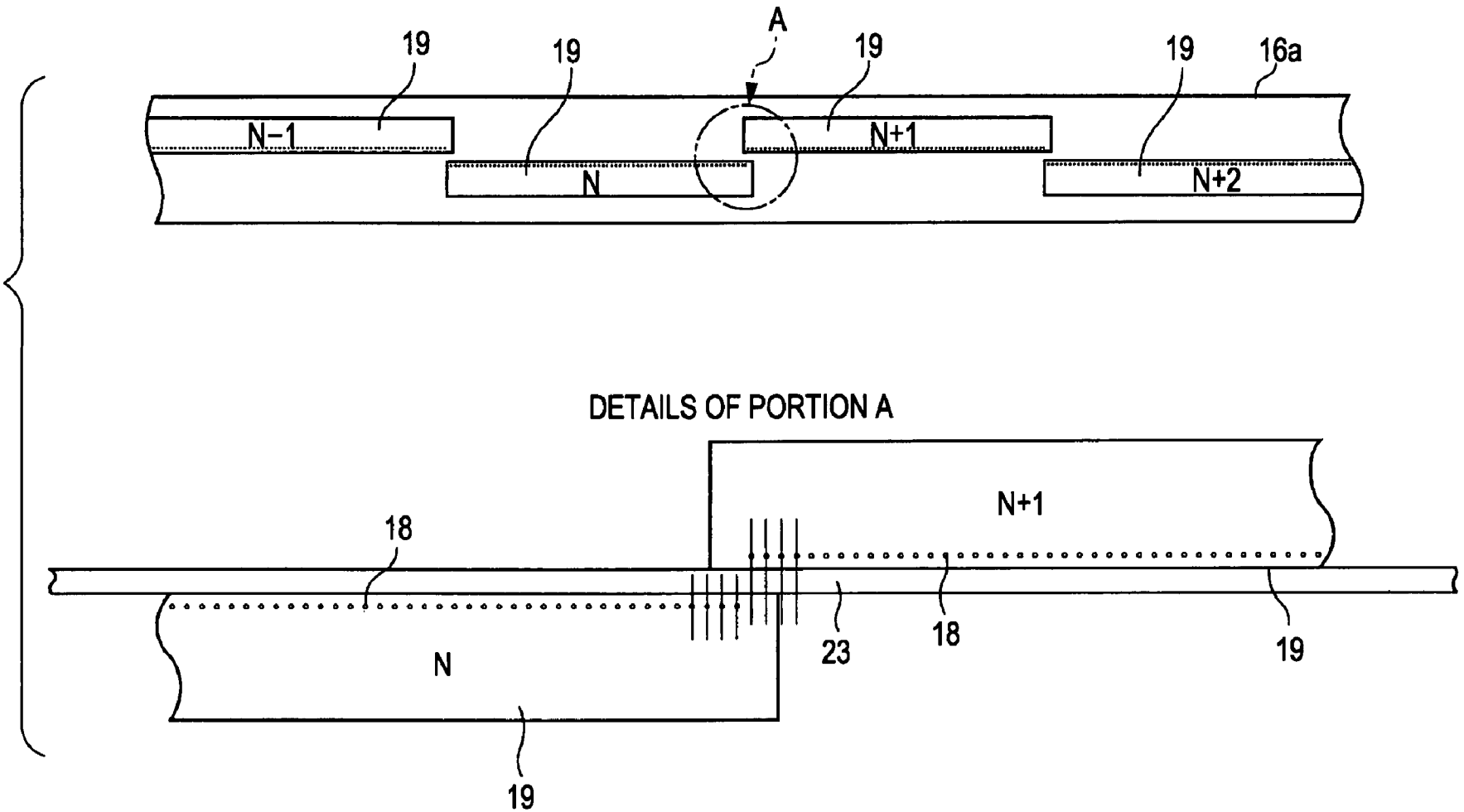
FIG. 2 is a plan view showing one head chip row.

FIG. 2 is a plan view showing one head chip 19 row. It should be noted that in FIG. 2, the head chips 19 and the nozzles 18 are depicted in an overlapping manner.

The respective head chips 19 are arranged in a staggered fashion, that is, in such a way that the orientations of adjacent head chips 19 differ from each other by 180 degrees. Further, as shown in FIG. 2, a common channel 23 for supplying liquid to all the head chips 19 is formed between the (N−1)-th and (N+1)-th head chips 19 and the N-th and (N+2)-th head chips 19.

Further, as shown in FIG. 2, the intervals between the respective nozzles 18 are all equal, including that at the portion where the nozzles 18 are placed adjacent to each other in a staggered fashion.

The head line 10 as described above is held stationary within the printer body. A recording medium is moved relative to the line head 10 thus held stationary, with a predetermined gap being maintained between the surface (liquid-impacting surface) of the recording medium and the liquid-ejecting surface (the surface of the nozzle sheet 17) of the line head 10. As liquid is ejected from each nozzle 18 of the head chip 19 during this relative movement, dots are arrayed on the recording medium, thereby effecting color printing of a letter, an image, or the like.

Next, the head chip 19 according to this embodiment will be described in more detail. The head chip 19 is the same as the head chip 1*a* according to the related art in that a plurality of heater elements 12 are arrayed on the semiconductor substrate 11. However, the head chip 19 differs from the head chip 1*a* in the manner in which the heater elements 12 are arrayed, the configuration of the liquid chamber 13*a*, and the like.

Figure 3:
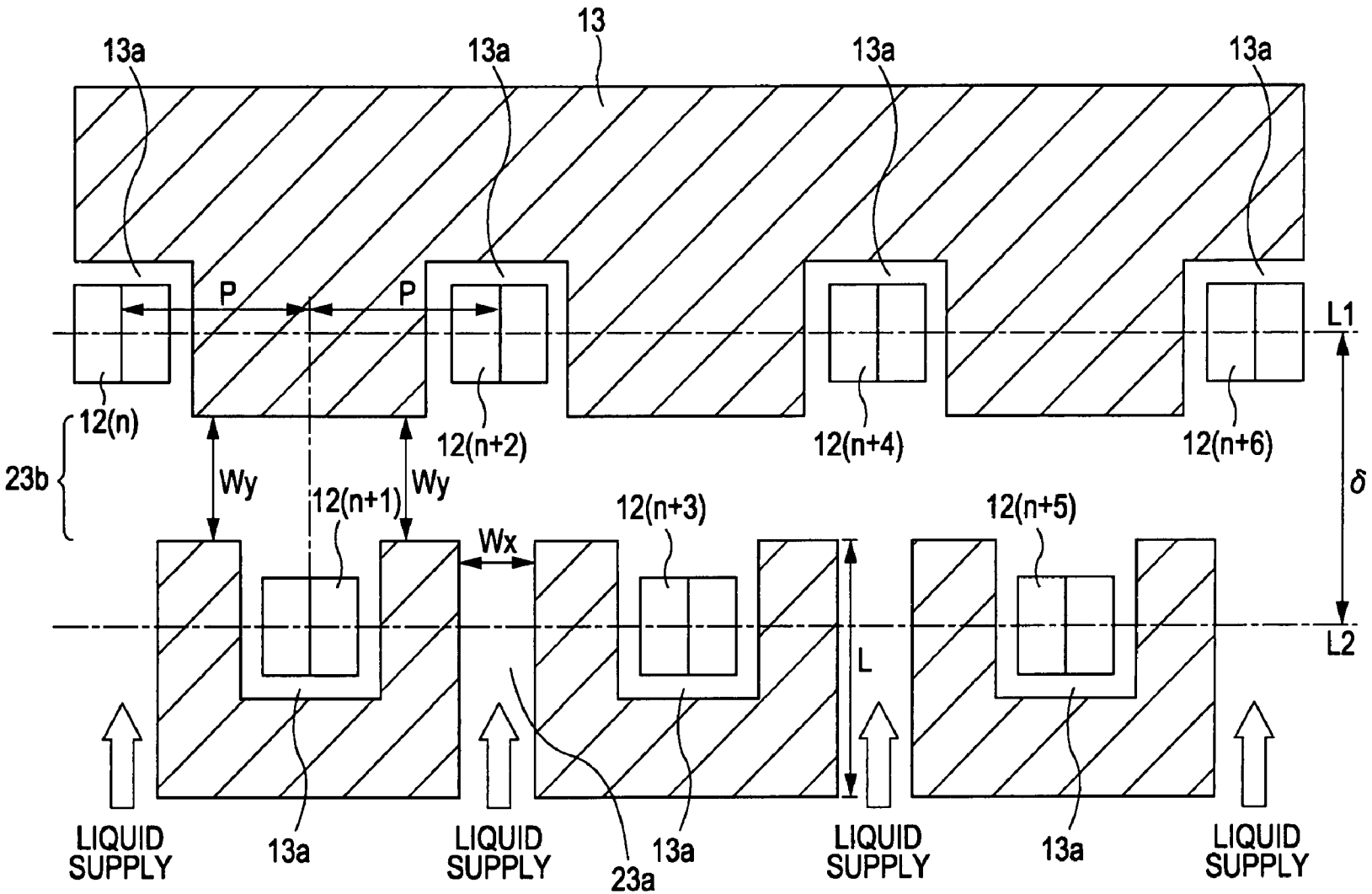
FIG. 3 is a plan view showing the configuration of a head chip according to the embodiment.

FIG. 3 is a plan view showing the configuration of the head chip 19 according to this embodiment.

As in the related art, the plurality of heater elements 12 are arrayed on the semiconductor substrate 11. Here, the centers of some of the heater elements 12 (n, n+2, n+4, n+6, etc. in FIG. 3) are arranged so as to be located on a (imaginary) straight line L1. On the other hand, the centers of the other heater elements (n+1, n+3, n+5, etc. in FIG. 3) are arranged so as to be located on a (imaginary) straight line L2.

Further, the straight lines L1 and L2 are parallel to each other and separated from each other by an interval δ (δ is a real number larger than 0). Further, although not shown in FIG. 3, the straight line L1 and the straight line L2 are provided in proximity to an outer edge (the lower side in FIG. 3) in the longitudinal direction of the head chip 19 (semiconductor substrate 11) so as to be in parallel to the outer edge.

Further, as shown in FIG. 2, on the outer side of the above-mentioned outer edge, the common channel 23 for supplying liquid to the respective liquid chambers 13*a* is provided so as to extend along the above-mentioned outer edge of the head chip 19 (semiconductor substrate 11). It should be noted that like the common channel 23 according to the related art shown in FIG. 13, the common channel 23 is formed by using the side surface of the semiconductor substrate 11 adjacent to the surface on which the heater elements 12 are formed, and, for example, the dummy chip D.

Accordingly, the straight line L1 and the straight line L2 are parallel to the common channel 23 (the above-mentioned outer edge of the semiconductor substrate 11) and arranged so as to be located on one side of the common channel 23.

Of the plurality of heater elements 12, the center of the heater element 12 located at the M-th position (M is either an odd number or even number) as counted from one end side is arranged on the straight line L1 extending along the array direction of the heater elements 12. Further, the center of the heater element 12 located at the N-th position (N is an even number when M is an odd number, and N is an odd number when M is an even number) as counted from one end side is arranged on the straight line L2. That is, the heater elements 12 are arranged alternately in a so-called staggered fashion on the straight line L1 and the straight line L2.

Further, the heater elements 12 on the straight line L1 and the heater elements 12 on the straight line L2 are both arranged at an interval distance of 2P (2×P). Further, the heater element 12 arranged on the straight line L1, and the heater element 12 arranged on the straight line L2 and located closest to that heater element 12 are arranged so as to be offset by a pitch P with respect to the array direction of the heater elements 12.

Accordingly, the respective heater elements 12 are arrayed at the constant pitch P in the directions of the straight line L1 and straight line L2. The pitch P is determined by the resolution (DPI) of the line head 10. The pitch P is about 42.3 (μm) at 600 DPI, for example.

The liquid chambers 13*a* are provided on the semiconductor substrate 11 and formed by a part of a barrier layer 13 arranged between the semiconductor substrate 11 and the nozzle sheet 17. In the example shown in FIG. 3, the liquid chambers 13*a* for the heater elements 12 located on the straight line L1 in FIG. 3 are formed in a substantially recessed configuration in plan view so as to surround three sides of the heater elements 12. The liquid chambers 13*a* are integral with the barrier layer 13 and formed by cutting away a part of the barrier layer 13 in a substantially recessed configuration. Accordingly, the liquid chambers 13*a* for the heater elements 12 located on the straight line L1 are provided so that their opening portions face the straight line L2 side.

In contrast, the liquid chambers 13*a* for the heater elements 12 located on the straight line L2 are formed in a substantially recessed configuration so as to surround three sides of the heater elements 12, and each liquid chamber 13*a* is separated and independent from the other liquid chambers 13*a*. Further, the liquid chambers 13*a* are provided so that their opening portions face the straight line L1 side.

Accordingly, the liquid chambers 13*a* surrounding the heater elements 12 on the straight line L1, and the liquid chambers 13*a* surrounding the heater elements 12 on the straight line L2 are arranged so that their respective opening portions face each other.

It should be noted that the lengths of the respective portions of each liquid chamber 13*a* surrounding the heater element 12 are not particularly limited as far as they are larger than the length of one side of the heater element 12 opposed to that liquid chamber 13*a*. In this embodiment, the liquid chamber 13*a* is provided so as to surround the heater element 12 while leaving a gap on the order of several μm around the heater element 12.

Further, a gap Wx (Wx is a real number larger than 0) is formed between each two liquid chambers 13*a* arranged on the straight line L2 and spaced apart from each other by the distance 2P (between two adjacent liquid chambers 13*a* on the straight line L2), with respect to the array direction of the liquid chambers 13*a* (the direction of the straight line L2). That is, the gap Wx is formed on both sides of each liquid chamber 13*a* with respect to the array direction of the liquid chambers 13*a*.

This gap Wx forms a first common channel 23*a* (a channel having a width of Wx and through which liquid flows in the direction perpendicular to the straight lines L1 and L2), which constitutes a part of the common channel 23 for supplying liquid (ink) to each liquid chamber 13*a* and communicates with the common channel 23.

It should be noted that since the liquid chambers 13*a* on the straight line L1 are formed integrally with the barrier layer 13*a* (contiguous to the barrier layer 13), no gap Wx is formed between adjacent liquid chambers 13*a* on the straight line L1.

Further, a gap Wy (Wy is a real number larger than 0) is formed between the straight line L2-side end of each liquid chamber 13*a* arranged on the straight line L1 and the straight line L1-side end of each liquid chamber 13*a* arranged on the straight line L2, with respect to the direction perpendicular to the array direction of the liquid chambers 13*a*. Like the above-mentioned gap Wx, this gap Wy forms a second common channel 23*b* (a channel having a width of Wy and through which liquid flows in the direction along the straight lines L1 and L2), which constitutes a part of the common channel 23 for supplying liquid (ink) to each liquid chamber 13*a* and communicates with the common channel 23.

As for the relationship between the gap Wx and the gap Wy, it is desirable that Wx<Wy. By forming the channels in this way, liquid can be supplied directly from the second common channel 23*b* (without via the individual channels 3*d* as described with reference to the related art) to each of the liquid chambers 13*a*, and the liquid supply capacity to the respective liquid chambers 13*a* can be enhanced and made uniform. This makes it possible to reduce a variation in ejection characteristics between the respective liquid ejecting portions and reduce the occurrence of bubble trouble at the respective liquid ejecting portions.

It should be noted that the desirability of the relationship Wx<Wy applies not only to the embodiment shown in FIG. 3 but also to embodiments shown in FIGS. 4, 5, and 6 that will be described later.

Figure 4:
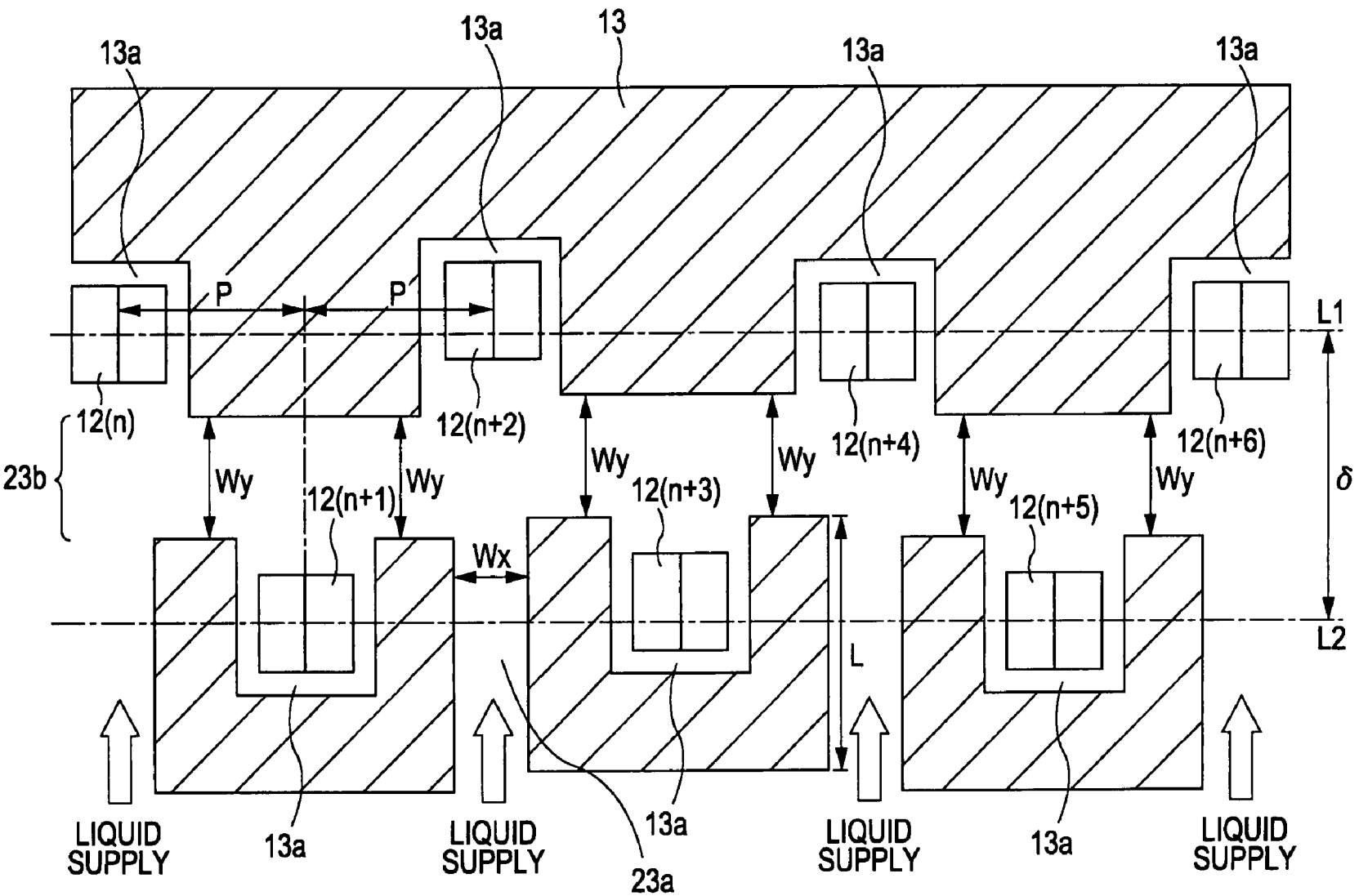
FIG. 4 is a plan view of another embodiment of the head chip, illustrating a modification of the embodiment shown in FIG. 3.

FIG. 4 is a plan view of another embodiment of the head chip 19, illustrating a modification of the arrangement shown in FIG. 3. In the example shown in FIG. 3, all the heater elements 12 are arranged so that their centers are accurately located on the straight line L1 or the straight line L2. In contrast, in the example shown in FIG. 4, some of the heater elements 12 are arranged at a suitable spacing from the straight line L1 and the straight line L2. In FIG. 4, of the heater elements 12, the centers of the heater elements 12*n*, 12(n+4), and 12(n+6) are located on the straight line L1.

In contrast, of the heater elements 12, the center of the heater element 12(n+2) is slightly shifted from the straight line L1. The amount of this shift is, for example, ±δ/5 or less. Likewise, on the straight line L2 side, of the heater elements 12, the centers of the heater elements 12(n+1) and 12(n+5) are located on the straight line L2, whereas the center of the heater element 12(n+3) is slightly shifted from the straight line L2. The amount of this shift is the same as that mentioned above.

As described above, the centers of the heater elements 12 are not necessarily arranged accurately on the straight line L1 or L2 but slight shift is permitted. It suffices for the heater elements 12 to be arranged sequentially in an alternating fashion on the straight line L1 or in its vicinity and on the straight line L2 or in its vicinity such that the heater elements 12 can be regarded as being arrayed in a staggered fashion.

Figure 5:
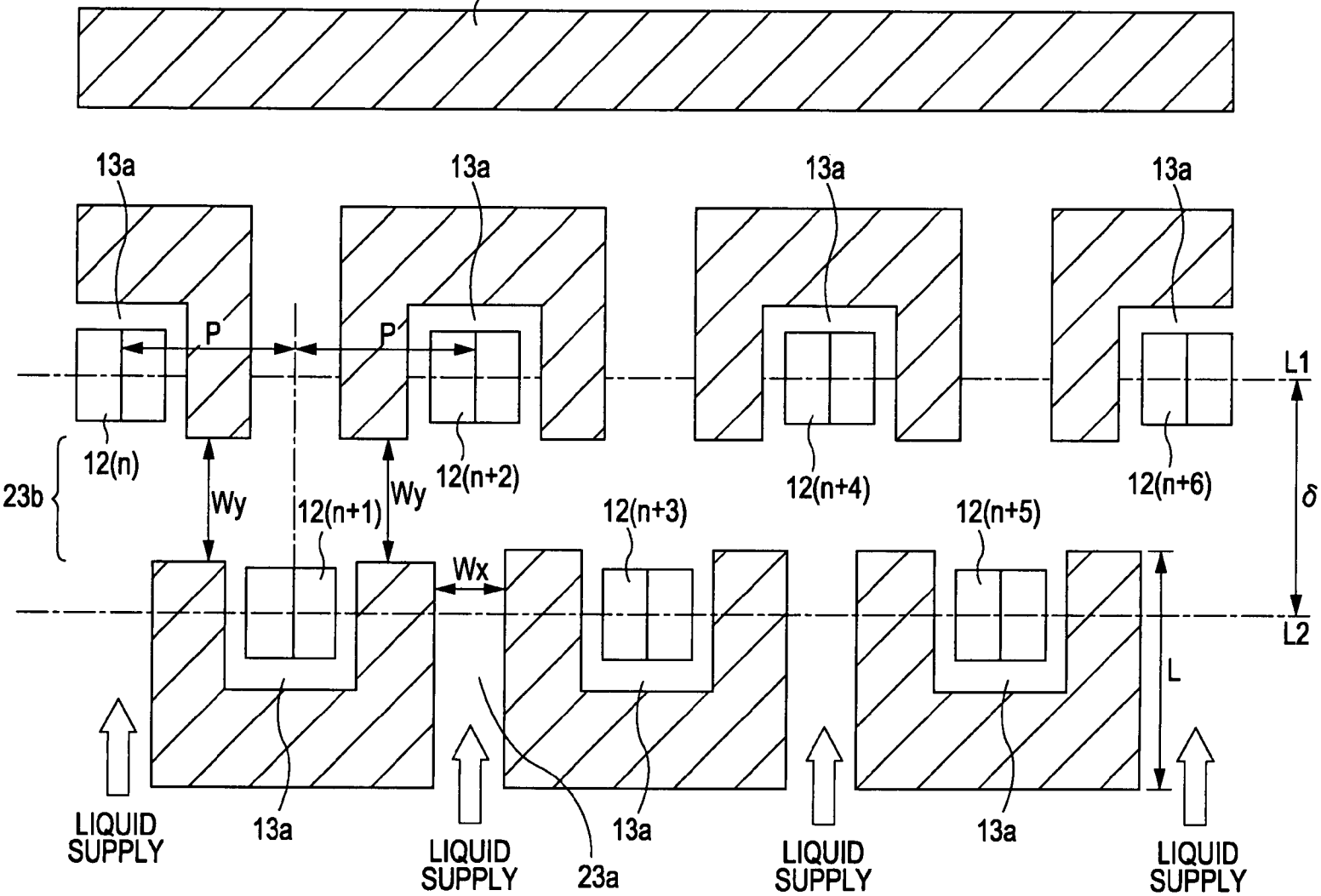
FIG. 5 is a plan view of still another embodiment of the head chip, illustrating a modification of the embodiment shown in FIG. 3.

FIG. 5 is a plan view of still another embodiment of the head chip 19, illustrating a modification of the arrangement shown in FIG. 3. In the example shown in FIG. 3, the liquid chambers 13*a* surrounding the heater elements 12 located on the straight line L1 are formed integrally with the barrier layer 13. In contrast, in the example shown in FIG. 5, the liquid chambers 13*a* surrounding the heater elements 12 located on the straight line L1 are also formed such that, like the liquid chambers 13*a* surrounding the heater elements 12 located on the straight line L2, each liquid chamber 13*a* is separated and independent from the other liquid chambers 13*a*.

Accordingly, the opening portions of the liquid chambers 13*a*, which are formed in a substantially recessed configuration in plan view, face each other. According to this arrangement, the reflection conditions or the like with respect to the shock wave at the time of liquid ejection can be made as uniform as possible for all the liquid ejecting portions. Further, it is possible to make the tension distribution of the nozzle sheet 17 uniform.

Figure 6:
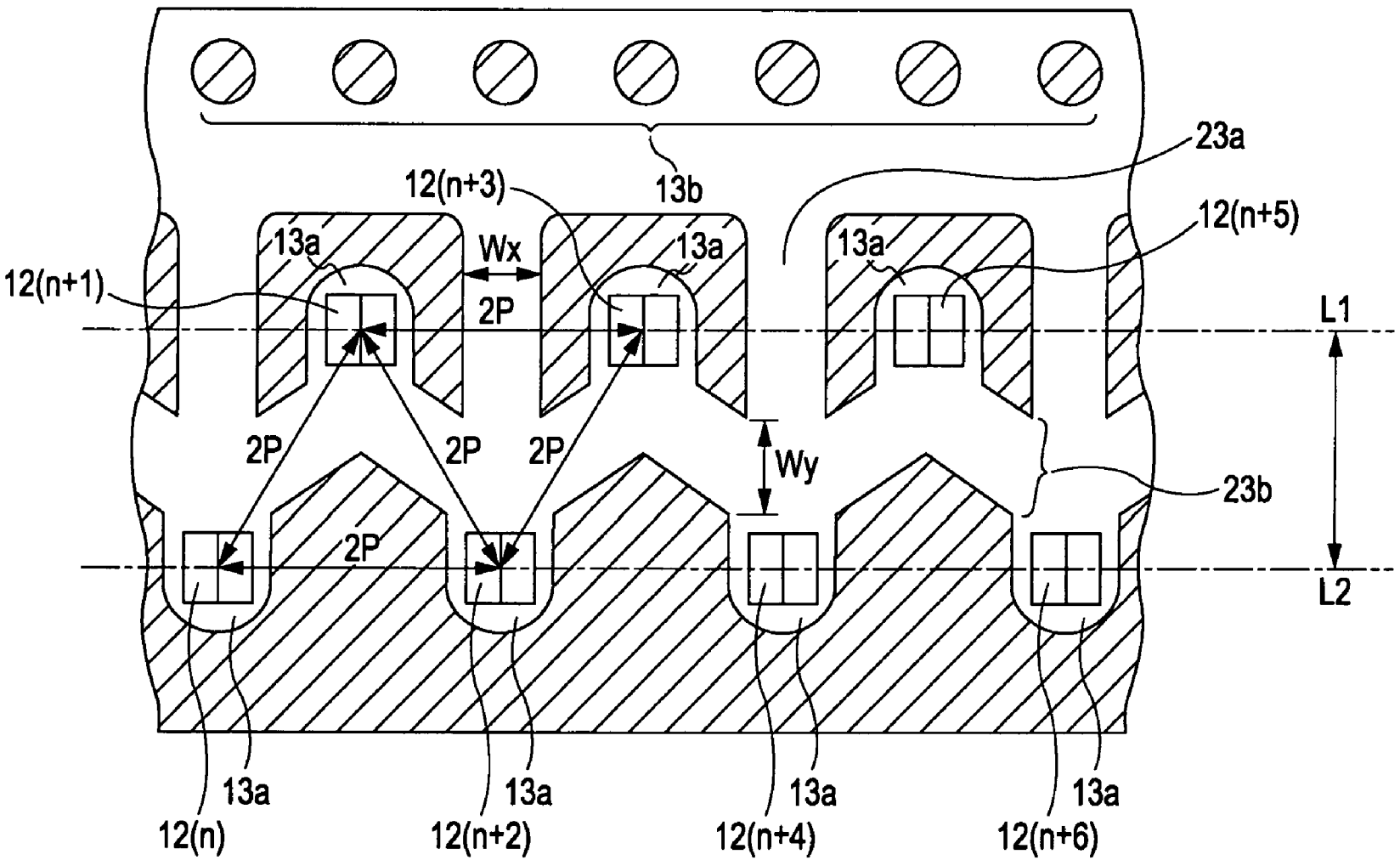
FIG. 6 is a view showing yet still another embodiment of the head chip.

FIG. 6 is a view showing yet still another embodiment of the head chip 19. It should be noted that cylindrical filters 13*b* are provided in FIG. 6. In the embodiment shown in FIG. 6, the row-to-row distance 6 between the staggered arrays is set to be $\sqrt{3}$ (≈1.73) times of the nozzle pitch P. The reason for this is as follows. That is, by setting the center-to-center distances between nozzles 18 arranged adjacent to each other on one of the straight lines to be all 2P, that is, to be equal, the probability with which interference occurs between nozzles due to mist (spray droplets produced at the time of ejection) deposited in the vicinity of the nozzle center of the nozzle surface or due to "overflow" of liquid from the nozzles (a phenomenon may occur in which liquid temporarily overflows at once from a large range of nozzles accompanying the ejecting operation) can be made uniform with respect to each of the nozzles.

Another characteristic feature of the embodiment shown in FIG. 6 resides in that the portion constituting the second common channel 23*b* (the portion between the straight lines L1 and L2) is formed in a zigzag configuration with respect to the array of the nozzles 18. The reason for this is as follows. That is, if the second common channel 23*b* is formed as a chevron-shaped wall as shown in FIG. 6, even when bubbles remain within the second common channel 23*b* due to the ejection pressure at the time of ejection from each of the nozzles 18 that successively takes place, since the wall of the channel has a chevron-shaped configuration, the bubbles are pushed away toward either of the adjacent nozzles 18. As a result, the above-mentioned residual bubbles are effectively discharged during the ejection cycle of that adjacent nozzle 18.

It should be noted that the width Wy according to the present invention refers to a value as measured in the direction perpendicular to the array direction of the nozzles 18, even in the case where the wall of the channel has a chevron-shaped configuration as shown in FIG. 6.

The embodiment shown in FIG. 6 is advantageous in that since the nozzle intervals (which are not the pitches but the center-to-center distance between mutually adjacent nozzles 18) are all set as 2P, on the nozzle surface, the performance at the pitch P can be exerted while substantially maintaining the stability of a head whose pitch is 2P, that is, a head whose resolution is half. It should be noted that the reason why no trouble occurs in signal processing even through δ is not an integer multiple of P as can be seen in FIG. 6 is that due to the technique proposed by the present applicant in Japanese Patent Application No. 2005-87430 that has not been laid open, a shift in nozzle position in the direction perpendicular to the staggered nozzle array can be corrected (in an analog fashion) to an arbitrary position in the direction perpendicular to the head array without performing clock processing in a digital fashion.

With this operation, even through the nozzles 18 are arrayed in a staggered fashion, when dots are impacted on the recording medium, the dots can be arrayed as if they were ejected from heads that are linearly arranged at the nozzle pitch P.

The channel structure according to this embodiment as described above provides the following features.

(1) First, from the viewpoint of strength, the channel structure provides the following feature.

The liquid ejecting portions are arrayed alternately in a staggered fashion on the straight line L1 and on the straight line L2. Accordingly, when looking at either one of the straight lines L1 and L2, the resolution of the head becomes ½. Since a higher mechanical strength can be attained as the resolution of the head becomes lower, by adopting the array according to this embodiment, it is possible to enhance the mechanical strength.

Further, in the liquid ejecting portions arrayed in a staggered fashion, since the liquid chambers 13*a* having a substantially recessed configuration in plan view are provided on both one side (the straight line L1 side) and the other side (the straight line L2 side), the same strength can be secured irrespective of the direction. Further, the opening portions of the respective liquid chambers 13*a* are directed to mutually face inward. Accordingly, when a pressure (surface pressure) is exerted on the end portion (the portion where the liquid ejecting portions are arrayed) of the head chip 19, the pressure is borne by the outer side portion with a high strength, and the inner side portion with a low strength is protected. That is, although the strength becomes the lowest at the opening ends of the opening portions of the liquid chambers 13*a*, these low-strength portions are protected by being made to mutually face inward. This makes the structure highly resistant to an external pressure exerted at the time of or after the adhesion with the nozzle sheet 17.

Further, since the liquid chambers 13*a* are arranged so as to be offset by the pitch P on the straight line L1 and on the straight line L2, on both sides in the vicinity of the opening of each liquid chamber 13*a*, walls of the liquid chambers 13*a* are present so as to face each other with the gap Wy therebetween. In the same manner as mentioned above, this realizes a structure that does not readily deform even when applied with a pressure (surface pressure).

Further, as in the head chip 1*a* according to the related art (FIG. 13), a structure in which the portion of the individual channels 3*d* is long and formed in a substantially comb-tooth configuration has a drawback in that distortion becomes large relative to the applied force. In contrast, the liquid chambers 13*a* according to this embodiment have a substantially recessed configuration in plan view, with a beam provided also in the array direction of the liquid chambers 13*a*. The strength can be thus enhanced, and distortion can be made small even upon the application of a large force.

Figure 13:
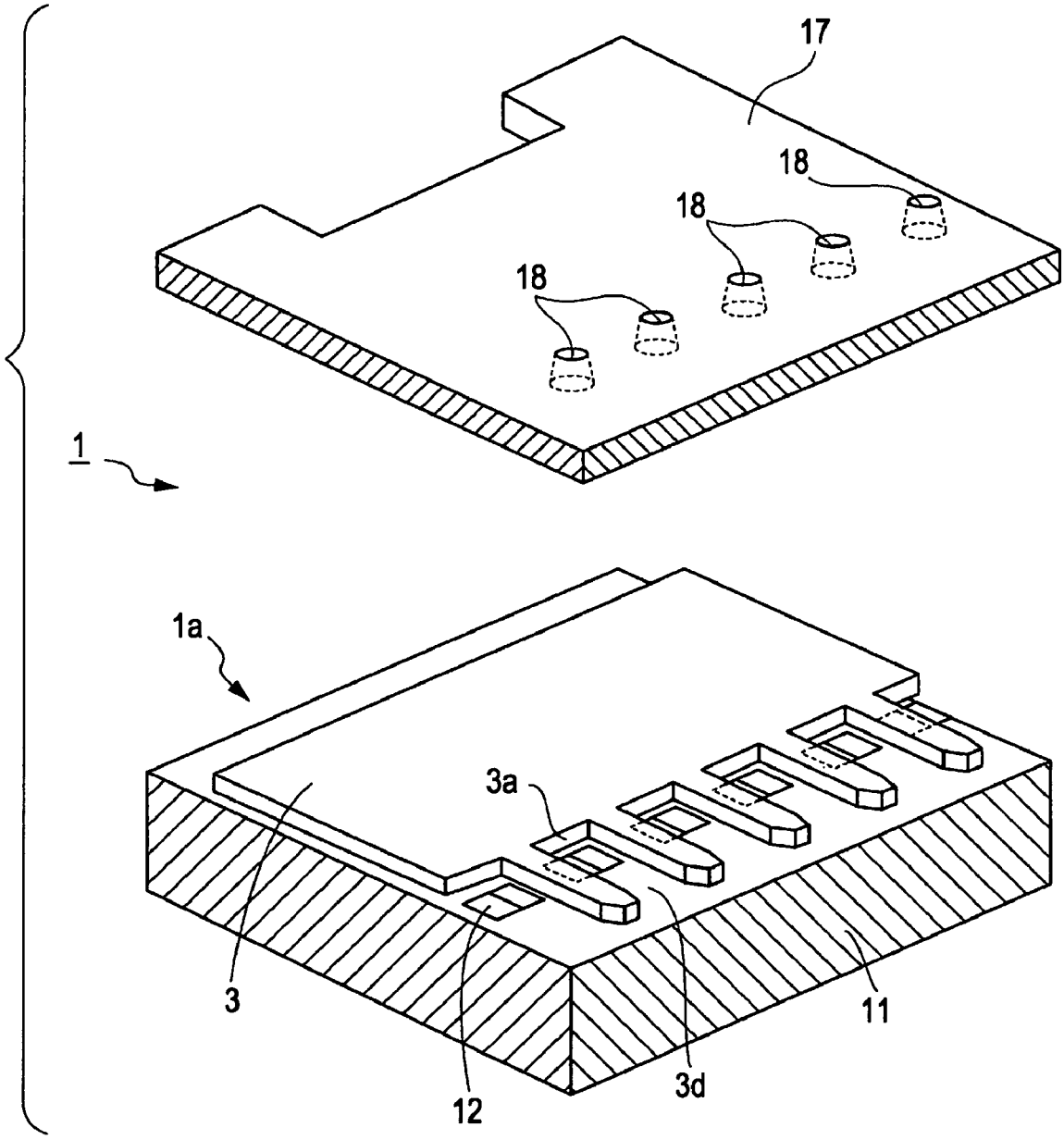
FIG. 13 is a perspective exterior view showing a liquid ejecting head according to the related art.
Figure 14:
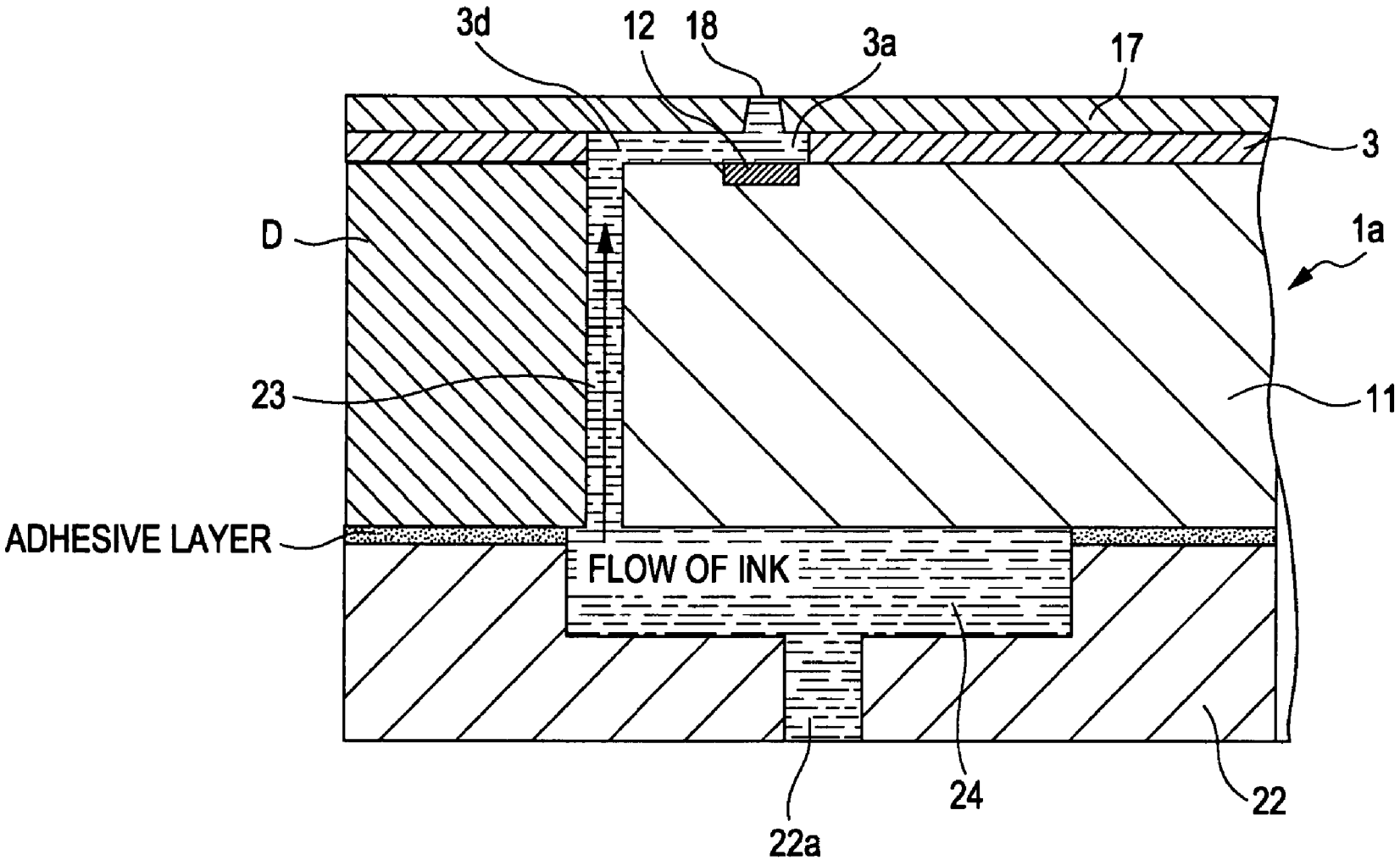
FIG. 14 is a sectional view showing the channel structure of the head shown in FIG. 13.

Further, in the case of the resolution of, for example, 600 DPI, the heater elements 12 are arranged at a pitch of about 42.3 μm and, as shown in FIG. 13, only a width of about 15 to 17 μm can be secured as the width of the barrier layer 13 between the heater elements 12. In contrast, when the heater elements 12 are arrayed as in this embodiment, a thickness of about 60 μm can be secured as the thickness (of the wall of) of each liquid chamber 13*a*, thereby making it possible to ensure sufficient strength. It is thus possible to ensure sufficient strength also with respect to lateral displacement (distortion of the liquid chambers 13*a* with respect to a force acting in the array direction of the heater elements 12).

(2) Further, although not shown in FIG. 13, the head chip according to the related art has a large number of through-holes formed at the central portion of the semiconductor substrate. In this embodiment, in contrast, although the heater elements 12 are arrayed in a staggered fashion, no channel (through-hole) penetrating through the semiconductor substrate 11 is formed between the staggered arrays (between the straight line L1 and the straight line L2). That is, the first common channel 23*a* and the second common channel 23*b* are formed by the flat portion on the semiconductor substrate 11 where no barrier layer 13 and no liquid chamber 13*a* are formed, and are not formed by penetrating the semiconductor substrate 11. It should be noted that as long as it is not a through-hole, a common channel formed in a groove-like configuration (so as to have a substantially recessed cross section), for example, may be provided between the staggered arrays. Further, as long as it is not formed between the staggered arrays, a common channel formed by a through-hole may be provided on the outer side of either one of the staggered arrays, for example.

Since no channel that extends through the semiconductor substrate is formed between the staggered arrays as described above, the head chip 19 can be designed to have a small size. It is thus possible to realize low cost (because the surface area of the head chip 19 directly affects the cost). Further, since a space for liquid supply is required for the head chip 19, this requirement can be met if the head chip 19 can be made small.

Further, when through-holes are formed in the semiconductor substrate as in the related art example, it is necessary to provide drive circuit rows separately on both sides of the through-holes, which causes an increase in the amount of circuitry required, and also a two-fold increase in the head chip surface area. Further, connecting pads of a large surface area are separately required, leading to a further increase in surface area. In contrast, with the arrangement according to this embodiment, design as a single electronic circuit (electronic circuit will be described later) is possible on both sides of the heater elements 12 arrayed on the straight line L1 and heater elements 12 arrayed on the straight line L2. Further, the reduced size of the head chip 19 means that a larger allowance is permitted in the design of the liquid supply system, thereby making it possible to reduce the size of the line head 10 as a whole.

(3) Further, by arraying the heater elements 12 on the straight line L1 and on the straight line L2 in a staggered relation with respect to each other as in this embodiment, a distance can be secured between the heater elements 12. That is, when looking at the straight line L1, for example, since the heater elements 12 are arrayed at a pitch corresponding to the distance of 2P, the heater elements 12 can be arrayed at a distance that is twice the distance that yields the intended resolution. Accordingly, since some allowance is afforded for the mechanical accuracy, even when a resolution of, for example, 1200 DPI is required, a head chip 19 having that resolution can be manufactured.

(4) Further, this embodiment provides the following feature from the viewpoint of the flow of liquid supply.

FIGS. 7A to 7D are diagrams schematically showing how liquid is supplied with head chips of various types. In the drawings, the square indicated by the solid line represents a liquid chamber, and the circle indicated by the dotted line represents a nozzle.

Figure 7A:
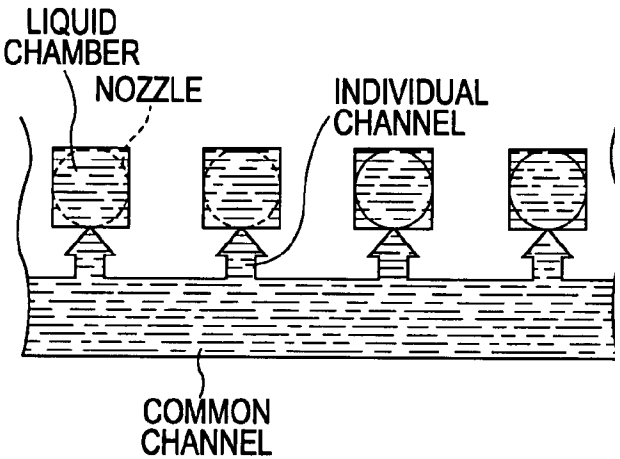
FIG. 7A RELATED ART
FIGS. 7A to 7D are diagrams schematically showing how liquid is supplied with head chips of various types.
Figure 7B:
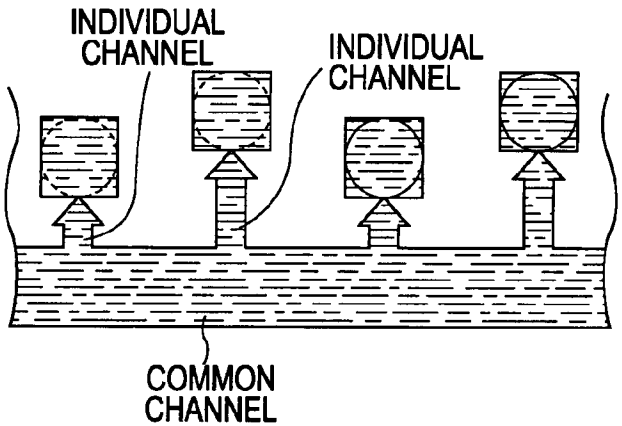
Figure 7C:
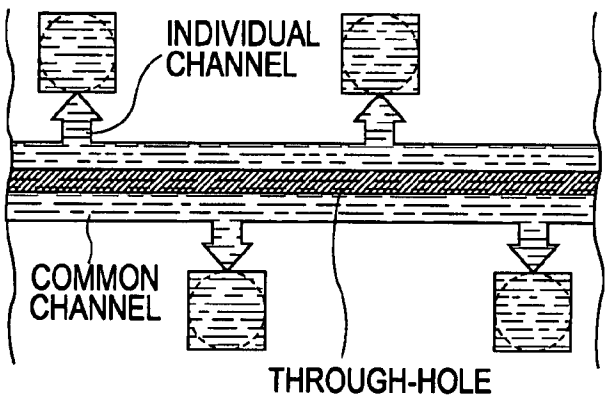
Figure 7D:
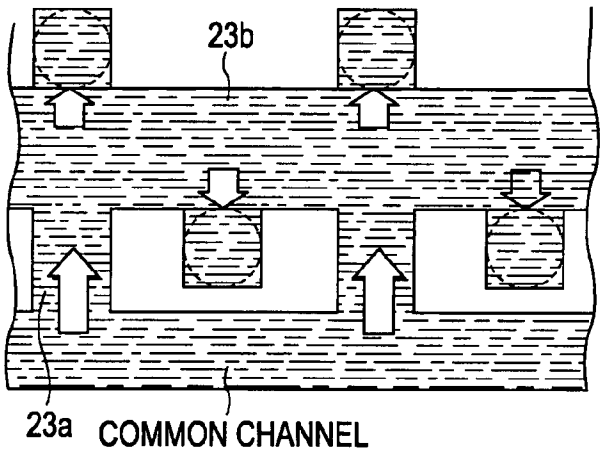

Of FIGS. 7A to 7D, FIG. 7A shows the flow of liquid according to the related art (for example, FIG. 13), and FIG. 7B shows the flow of liquid according to Japanese Patent Application No. 2003-383232 previously proposed by the present applicant. FIG. 7C shows the flow of liquid in the case where, as described above, a through-hole is formed so as to extend intermediate between the respective staggered arrays of heater elements. Further, FIG. 7D shows the flow of liquid according to this embodiment.

In each of the cases shown in FIGS. 7A to 7C, liquid is supplied to the respective liquid chambers via individual channels. This involves a problem in that when trouble occurs in an individual channel, liquid can no longer be supplied to the corresponding liquid chamber.

In the case shown in FIG. 7D, in contrast, liquid is supplied to each liquid chamber 13*a* from a plurality of directions so as to go around that liquid chamber 13*a*. Further, the liquid chamber 13*a* itself acts substantially like a filter for maintaining the pressure within the liquid chamber 13*a*. Accordingly, since both the liquid that is to enter the opening portion of the liquid chamber 13*a*, and the liquid that is to enter the opening portion of the liquid chamber 13*a* on the side opposite to the above-mentioned liquid chamber 13*a* enter the respective opening portions after passing through the first common channel 23*a* having the width Wx, liquid is supplied with substantially the same pressure to the opening portions of the liquid chambers 13*a* located on either of the straight line L1 and straight line L2.

(5) Further, with the channel structure according to this embodiment, the liquid ejection/refill characteristics can be made uniform. Unless these characteristics are made uniform, when an ejecting operation is performed under given conditions, a variation may occur in the amount of ejected droplets to cause ejection non-uniformity, or bubbles may be generated (the generation of bubbles leads to a significant decrease in ejection amount) due to a difference in operation speed.

In order to reduce such a variation, it is necessary to make the channel structure symmetrical or form the channel structure in such a manner that it looks the same when rotated. Accordingly, the structure as shown in FIG. 7B involves a factor causing a variation in characteristics, because the length from the common channel to the liquid chamber differ between the respective liquid chambers. In this embodiment, in contrast, liquid can be supplied to any one of the liquid chambers 13*a* under substantially the same conditions. The ejection/refill characteristics of the respective liquid ejecting portions can be thus made uniform.

(6) Further, in the case where a separately prepared nozzle sheet is boned onto the heater elements and liquid chambers provided on the semiconductor substrate, the thickness of the nozzle sheet (about 10 to 30 μm) is small relative to that of the head chip (thickness: about 600 to 650 μm), and tension is imparted to the nozzle sheet at room temperature.

When thermal stress is exerted or force is externally applied under such an environment, a change may occur in the tension of the nozzle sheet, causing distortion. In this embodiment, however, even when tension is exerted, each nozzle 18, which is the most sensitive to a change in tension, is surrounded by the substantially recessed portion of the liquid chamber 13*a*. Distortion due to tension thus does not readily occur, and it is possible to ensure a high level of stability over a broad temperature range.

(7) Further, when the viscosity or surface tension of the liquid is low, liquid level vibration or liquid pressure change in neighboring portions occurs during the propagation of the shock wave at the time of ejection or the subsequent refill operation, so it takes awhile for the meniscus to stabilize. One way to suppress the occurrence of such a phenomenon is to increase the length of the individual channel connecting between each liquid chamber and the common channel to thereby attenuate the shock wave or the vibration that is liable to occur during the refill operation by means of the channel resistance therebetween. However, when the length of the individual channel is increased, an ejection failure occurs in the event of bubble trouble. If the ejecting operation is repeated in this state as it is, this may lead to a burnout of the heater elements.

Accordingly, it is a common practice to make the individual channel short, provide a column (filter) used for the purpose of dust/dirt removal in front of the individual channel, and utilizes the attenuation due to the filter effect to mitigate the vibration or interference.

On the other hand, in this embodiment, each one of the separate and independent liquid chambers 13*a* facing the common channel 23 itself serves as the filter. Here, when the filter according to the related art is additionally provided, a double filter effect can be attained (see filters 30 in FIG. 11). It should be noted that the filter characteristics of the liquid chambers 13*a* can be optimized with respect to interference or vibration by appropriately selecting the values of the gap Wx and length L (see FIG. 3 or the like) of the liquid chambers 13*a*.

In particular, when the liquid chambers 13*a* are formed in a symmetrical configuration as shown in FIG. 5, the influence of the shock wave can be mitigated by providing a straight channel (channel having a width Wx) for absorbing the shock wave coming from the entrance of each liquid chamber 13*a*.

(8) The channel length from the common channel to each individual channel, and the channel resistance present therebetween affect the ejection pressure (ejection speed). In this embodiment, the flows of liquid having passed through the portions on both sides of the liquid chambers 13*a* merge in the second common channel 23*b* located intermediate between the liquid chambers 13*a* on the straight line L1 and the liquid chambers 13*a* on the straight line L2, before being distributed to the respective liquid chambers 13*a* over substantially equal distances (with the same channel resistance). Accordingly, even when the ejecting operation is performed successively, the ejection pressure (that is, the ejection speed) with which the liquid is ejected from the respective mutually opposed liquid ejecting portions can be maintained substantially the same.

Due to the above-described features, the channel structure according to this embodiment provides the following effects.

(1) First, the occurrence of bubble trouble is suppressed, and self-reset from such bubble trouble can be achieved. Further, since liquid is supplied from three sides to the opening of each liquid chamber 13*a*, a priming effect can be expected at all times.

(2) The ejection speed of droplets can be made constant (the ejection characteristics can be made uniform).

(3) Since a large distance can be secured between the liquid ejecting portions located on the same straight line (straight line L1 or straight line L2), the wall thickness of the liquid chamber 13*a* can be made large. As a result, it is possible to reduce a change in characteristics due to thermal expansion or mechanical distortion exerted on the line head 10.

(4) The mutual interference between the liquid ejecting portions due to ejection impact can be reduced (the filter effect can be made uniform and greater). (5) Since the periphery of the liquid chamber 13*a* is surrounded by liquid, and an increased proportion of heat generation is dependent on the liquid having a higher thermal conductivity than the barrier layer 13, an improvement can be achieved in terms of the heat radiation characteristics.

(6) Since the tension distribution of the nozzle sheet 17 becomes constant, it is possible to reduce a variation in characteristics between the nozzles 18.

(7) Since liquid can be supplied to the liquid chamber 13*a* from three directions, the resulting structure becomes resistant to dust or dirt.

(8) In the case of the same DIP or the same number of nozzles, the surface area of the head chip 19 can be reduced in comparison to the structure in which through-holes are formed at the central portion of the head chip 19.

Subsequently, an ejection direction deflecting mechanism according to this embodiment will be described.

As shown in FIG. 3 or the like, in this embodiment, the heater elements 12 that are split in two are arranged side by side within one liquid chamber 13*a*. The arrangement direction of the half-split heater elements 12 corresponds to the arrangement direction of the nozzles 18. It should be noted that although the positions of the nozzles 18 are not shown in FIG. 3 or the like, each nozzle 18 is arranged on each heater element 12 in such a manner than when the half-split heater elements 12 within one liquid chamber 13*a* is seen as one heater element 12, the center axis of the nozzle 18 coincides with the center axis of that heater element 12.

In the case of a half-split type element obtained by longitudinally splitting a single heater element 12 in two in this way, each half-split heater element 12 is the same in length and becomes half in width. The resistance of the heater element 12 thus becomes twice. When these half-split heater elements 12 are connected in series, this is equivalent to serially connecting heater elements 12 with twice the resistance, so the resulting resistance becomes 4 times as large (this is a calculation value that does not take into account the distance between the respective heater elements 12 provided side by side).

Here, in order to bring the liquid in the liquid chamber 13*a* into a boil, it is necessary to apply given electric power to the heater element 12 to heat the heater element 12. This is required to eject the liquid by the energy at the time of boiling. When the resistance is small, it is necessary to cause a large current to flow. However, by increasing the resistance of the heater element 12, the liquid can be brought to a boil with a small current.

Accordingly, the size of the transistor for causing the current to flow can be also reduced, thereby making it possible to achieve space saving. In this regard, although the resistance can be increased by reducing the thickness of the heater element 12, from the viewpoint of the material selected for the heater element 12 and the strength (durability), there is a certain limit to the reduction in the thickness of the heater element 12. Accordingly, rather than reducing the thickness of the heater element 12, the heater element 12 is split to achieve an increase in resistance.

Further, in the case where the half-split heater elements 12 are provided inside each one liquid chamber 13*a*, the periods of time (bubble generation time) it takes for the respective heater elements 12 to reach the temperature for boiling liquid are normally set to be the same. This is because the ejection angle of liquid does not become perpendicular when a difference occurs in bubble generation time between two heater elements 12.

Figure 8:
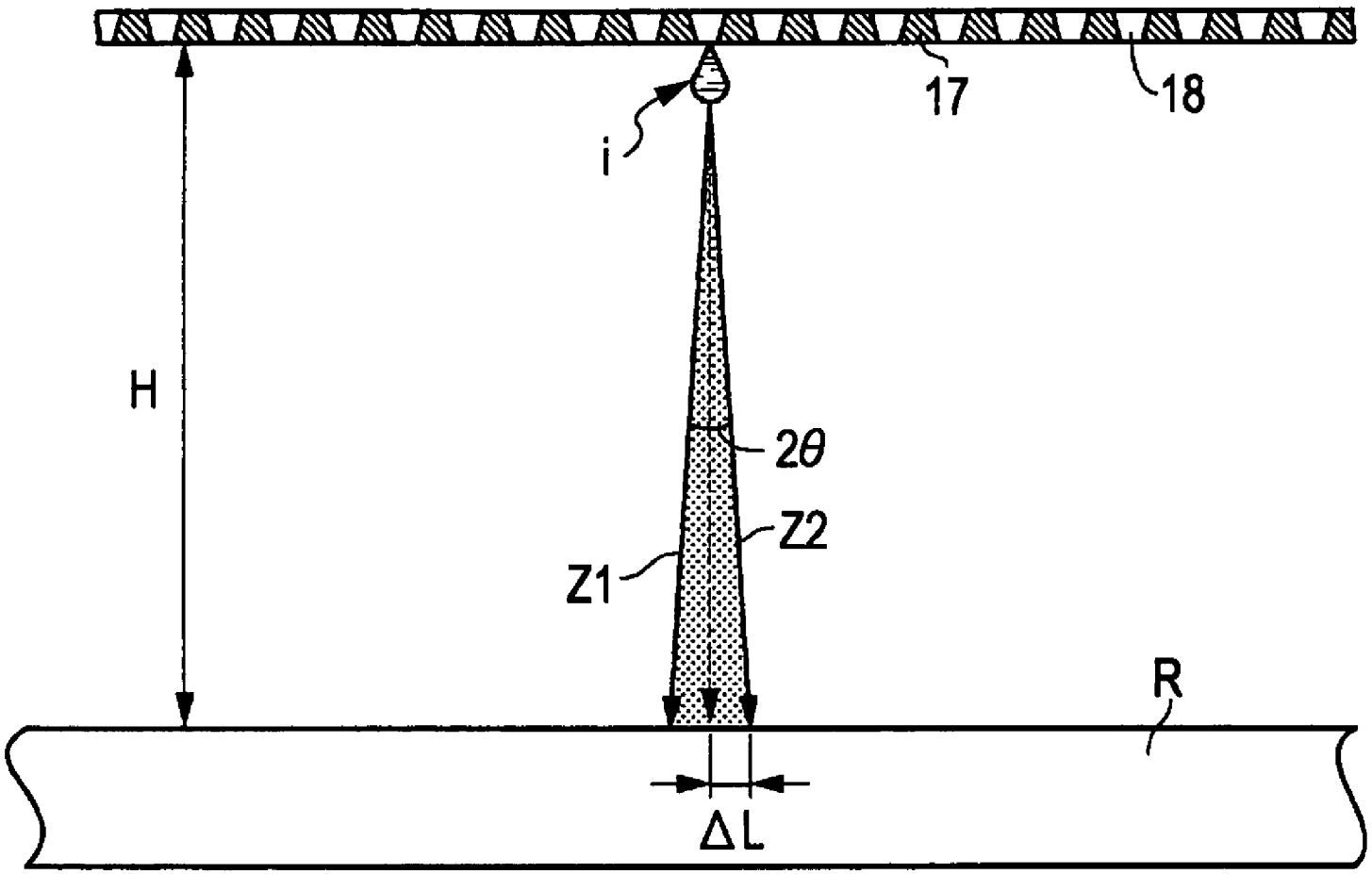
FIG. 8 is a diagram illustrating the ejection direction of liquid.

FIG. 8 is a diagram illustrating the liquid ejection direction. In FIG. 8, when liquid i is ejected perpendicularly with respect to the target ejection surface for the liquid i (the surface of a recording medium R), the liquid i is ejected straight as indicated by the dotted arrow in FIG. 8. In contrast, when the ejection angle of the liquid i is shifted by θ from the perpendicular direction (as in the Z1 or Z2 direction in FIG. 8), the impact position of the liquid i is shifted as follows.

$$\delta L = H \times \tan\theta$$

Here, the distance H represents the distance between the distal end of the nozzle 18 and the surface of the recording medium R, that is, the distance between the liquid ejecting surface of the liquid ejecting portion and the impact surface of the liquid (the same applies hereinafter). In the case of an ordinary inkjet printer, this distance H is on the order of 1 to 2 mm. Accordingly, it is assumed that the distance H is maintained constant as H=about 2 mm.

The reason why the distance H must be maintained substantially constant is that if the distance H varies, so does the impact position of the liquid i. That is, when the liquid i is ejected from the nozzle 18 perpendicularly with respect to the surface of the recording medium R, a slight variation in the distance H does not cause a change in the impact position of the liquid i. In contrast, when the ejection direction of the liquid i is deflected as described above, the impact position of the liquid i changes in accordance with the variation in the distance H.

Figure 9A:
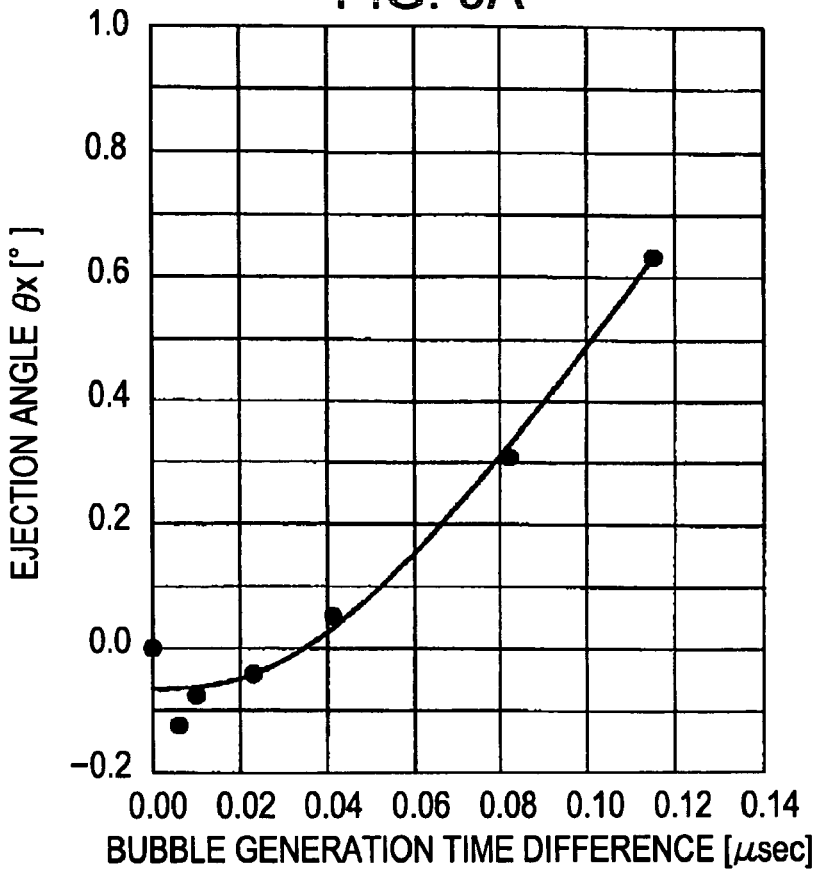
FIGS. 9A and 9B are graphs each showing the relationship between the difference in bubble generation time in liquid between half-split heater elements 12, and the ejection angle of the liquid.
Figure 9B:
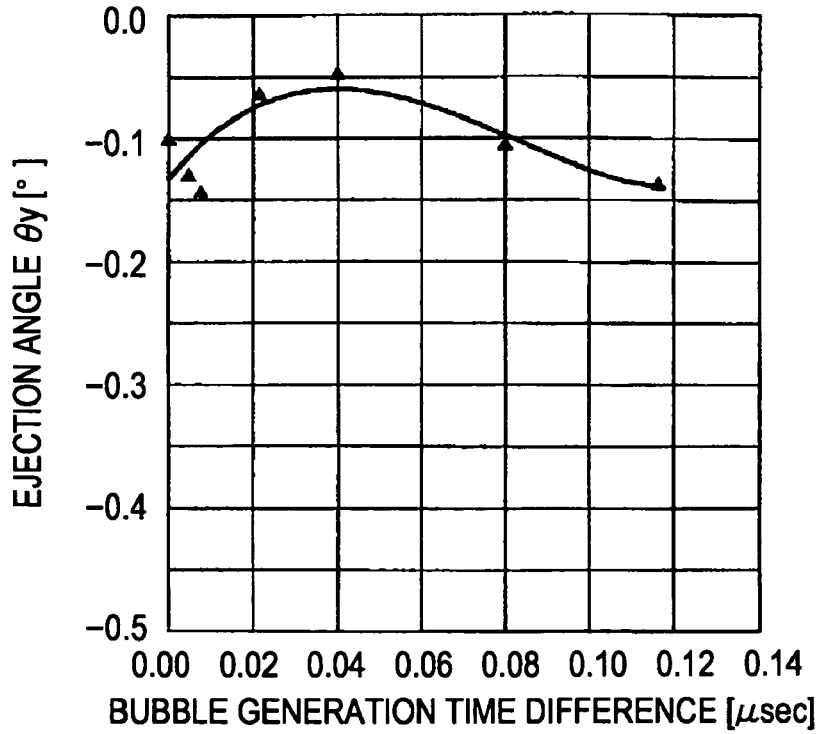
Figure 9C:
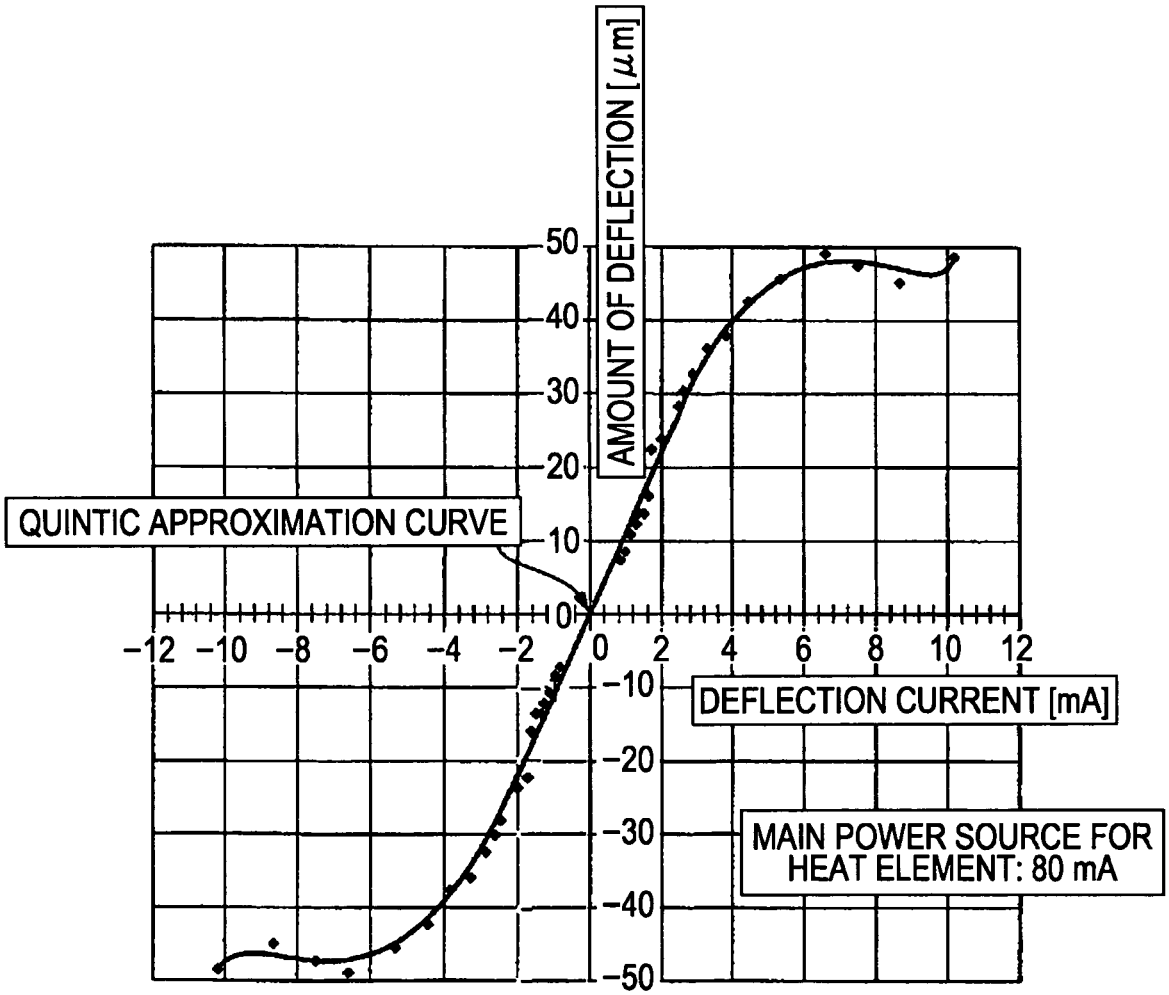
FIG. 9C shows actual measurement data indicating the relationship between the deflection current between the half-split heater elements 12, and the amount of shift at the impact position of liquid.

FIGS. 9A and 9B are graphs each showing the relationship between the difference in time at which bubbles are generated in liquid between the half-split heater elements 12, and the ejection angle of liquid, illustrating the results of computer simulation. In these graphs, the X direction represents the arrangement direction of the nozzles 18 (the direction in which the heater elements 12 are arranged side by side), and the Y direction represents the direction perpendicular to the X direction (the feed direction of the recording medium). Further, FIG. 9C shows the actual measurement data in the case where, as the difference in bubble generation time in liquid between two heater elements 12, ½ of the difference in the amount of current between the half-split heater elements 12 is taken along the horizontal axis as the deflection current, and the amount of shift at the impact position of the liquid (measured with the distance from the liquid ejecting surface to the impact position of the liquid on the recording medium set as about 2 mm) is taken along the vertical axis. In FIG. 9C, with the principal current of the heater element 12 set as 80 mA, the above-mentioned deflection current was superimposed on the heater element 12 on one side, and the liquid was ejected while deflecting the ejection direction thereof.

When there is a difference in the bubble generation time between the heater elements 12 that are split in two in the arrangement direction of the nozzles 18, as shown in FIG. 9, the ejection angle of the liquid does not become perpendicular, and the ejection angle θx (which is the amount of deviation from the perpendicular direction and corresponds to θ in FIG. 8) of the liquid with respect to the arrangement direction of the nozzles 18 becomes larger as the difference in bubble generation time increases.

In view of this, by taking advantage of this characteristic, by providing the heater elements 12 that are split in two, and by providing a difference between the amounts of current supplied to one heater element 12 and the other heater element 12, a control is performed so as to cause a difference between bubble generation times on the two heater elements 12 due to that difference in current amount, thereby deflecting the ejection direction of the liquid ejected from the nozzles 18 to a plurality of directions in the array direction of the liquid ejecting portions (nozzles 18) (ejection direction deflecting mechanism).

Further, when, for example, the resistances of the half-split heater elements 12 are not the same due to a manufacturing error or the like, a difference in bubble generation time occurs between the two heater elements 12, with the result that the ejection direction of liquid does not become perpendicular and the impact positions of the liquid deviate from the originally intended positions. However, when the time at which bubbles are generated on each heater element 12 is controlled by varying the amounts of current passed through the half-split heater elements 12 to thereby make the two heater elements 12 generate bubbles at the same time, the ejection direction of liquid can be made perpendicular.

For instance, in the line head 10, by deflecting the ejection direction of liquid from specific one or two or more head chips 19 as a whole with respect to the original ejection direction, it is possible to correct the ejection direction from those head chips 19 which do not eject liquid perpendicularly to the impacting surface of the recording medium due to a manufacturing error or the like, thereby making it possible to eject the liquid perpendicularly.

Further, another conceivable method includes deflecting the ejection direction of liquid from only specific one or two or more liquid ejecting portions in each one head chip 19. For example, when, in one head chip 19, the ejection direction of liquid from a specific liquid ejecting portion is not parallel to the ejection direction of liquid from other liquid ejecting portions, only the ejection direction of the liquid from that specific liquid ejecting portion is deflected, thereby making it possible to adjust the ejection direction so as to be parallel to the ejection direction of liquid from the other liquid ejecting portions.

Further, the ejection direction of liquid can be deflected as follows.

For example, in the case where liquid is to be ejected from a liquid ejecting portion "N" and from a liquid ejecting portion "N+1" adjacent to this, the impact positions of the liquid when ejected without undergoing deflection from the liquid ejecting portion "N" and the liquid ejecting portion "N+1" are taken as an impact position "n" and an impact position "n+1", respectively. In this case, the liquid can be ejected from the liquid ejecting portion "N" without undergoing deflection to be impacted on the impact position "n", or the liquid can be impacted on the impact position "n+1" by deflecting the ejection direction of the liquid.

Likewise, the liquid can be ejected from the liquid ejecting portion "N+1" without undergoing deflection to be impacted on the impact position "n+1", or the liquid can be impacted on the impact position "n" by deflecting the ejection direction of the liquid.

In this regard, when, for example, clogging or the like occurs in the liquid ejecting portion "N+1" so that it is difficult to eject the liquid from the liquid ejecting portion "N+1", it may normally be impossible to impact the liquid on the impact position "n+1". Thus, dot chipping occurs and the head chip 19 becomes deflective.

In such a case, however, liquid is ejected from another liquid ejecting portion, such as from the liquid ejecting portion "N" arranged adjacent to the liquid ejecting portion "N+1" on one side or from a liquid ejecting portion "N+2" arranged adjacent to the liquid ejecting portion "N+1" on the other side, thereby making it possible to impact the liquid on the impact position "n+1".

Next, the specific construction of the ejection direction deflecting mechanism will be described. The ejection direction deflecting mechanism according to this embodiment includes a current mirror circuit (hereinafter, referred to as the CM circuit).

Figure 10:
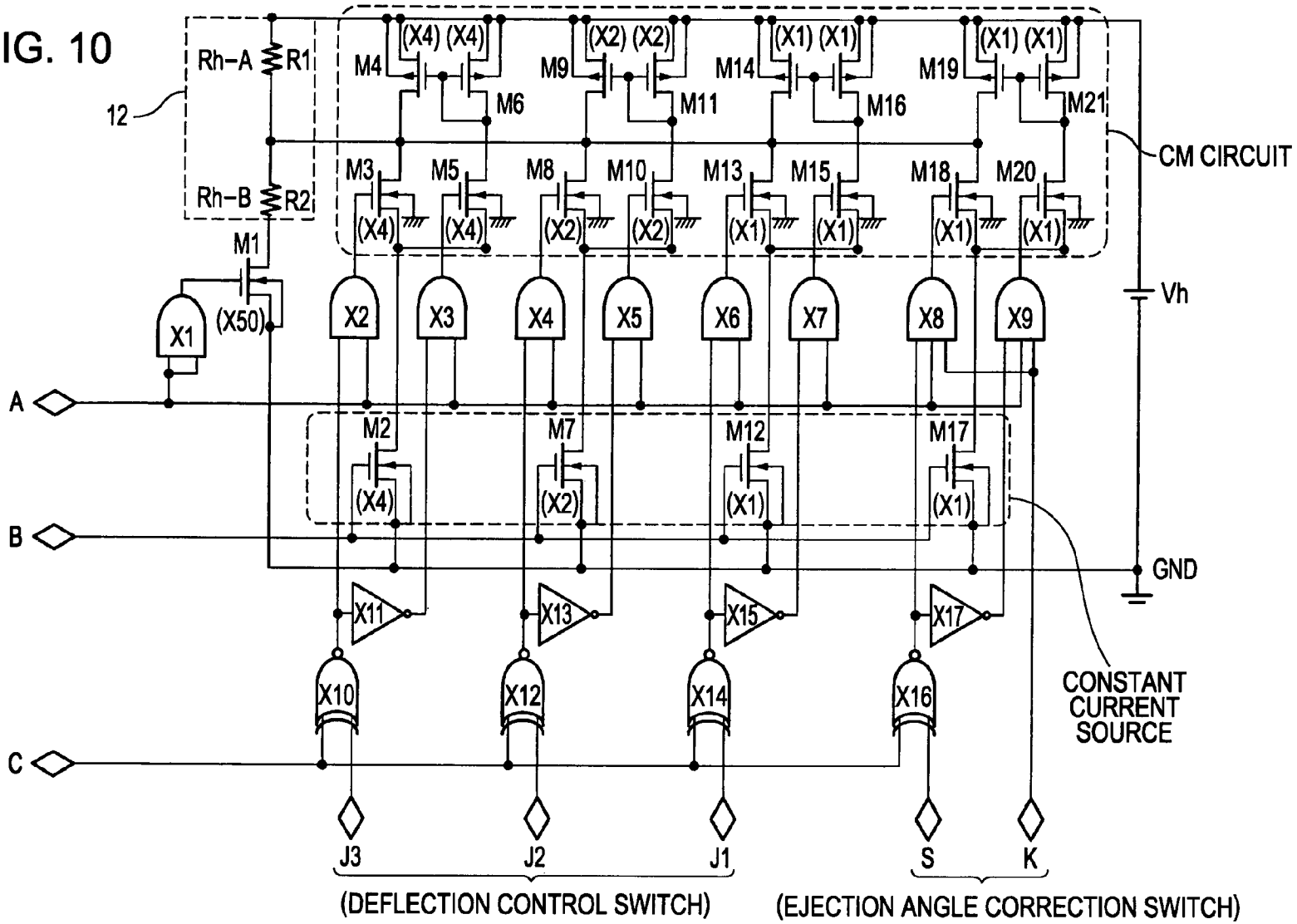
FIG. 10 is a diagram showing a circuit embodying an ejection direction deflecting mechanism according to the embodiment.

FIG. 10 is a diagram showing a circuit embodying the ejection direction deflecting mechanism according to this embodiment. First, elements used in this circuit and their connections will be described.

In FIG. 10, resistors Rh-A and Rh-B, which represent the resistors of the half-split heater elements 12 described above, are connected in series. A power source Vh is a power source for applying a voltage to each of the resistors Rh-A and Rh-B.

The circuit shown in FIG. 10 includes transistors M1 to M21. The transistors M4, M6, M9, M11, M14, M16, M19, and M21 are PMOS transistors, and the other transistors are NMOS transistors. In the circuit shown in FIG. 10, the transistors M2, M3, M4, M5, and M6 form one CM circuit, and there are provided four CM circuits in total.

In this circuit, the gate and drain of the transistor M6 and the gate of the transistor M4 are connected to each other. Further, the drains of the transistors M4 and M3 are connected to each other, and the drains of the transistors M6 and M5 are connected to each other. The same applies to the other CM circuits.

Further, the drains of the transistors M4, M9, M14, and M19, and of the transistors M3, M8, M13, and M18, each constituting a part of the CM circuit, are connected to the midpoint between the resistors Rh-A and Rh-B.

Further, the transistors M2, M7, M12 and M17 each serve as a constant current source for each of the CM circuits. The drains thereof are connected to the sources of the transistors M3, M5, M13, and M18, respectively.

Furthermore, the drain of the transistor M1, is connected in series to the resistor Rh-B. The transistor M1 is turned ON when an ejection execution inputting switch A becomes 1 (ON), and causes a current to flow to each of the resistors Rh-A and Rh-B.

Further, the output terminals of AND gates X1 to X9 are connected to the gates of the transistors M1, M3, M5, etc., respectively. It should be noted that while the AND gates X1 to X7 are of a two-input type, the AND gates X8 and X9 are of a three-input type. At least one of the input terminals of the AND gates X1 to X9 is connected with the ejection execution inputting switch A.

Furthermore, of each of XNOR gates X10, X12, X14, and X16, one input terminal thereof is connected to a deflection direction selector switch C, and the other input terminal thereof is connected to deflection control switches J1 to J3 or an ejection angle correction switch S.

The deflection direction selector switch C is a switch for selecting to which side the ejection direction of liquid is to be deflected with respect to the arrangement direction of the nozzles 18. When the deflection direction selector switch C becomes 1 (ON), one input of the XNOR gate X10 becomes 1.

Further, the deflection control switches J1 to J3 are each a switch for determining the deflection amount by which the ejection direction of ink droplets is to be deflected. When, for example, the input terminal J3 becomes 1 (ON), one input of the XNOR gate X10 becomes 1.

Further, the respective output terminals of the XNOR gates X10 to X16 are connected to one input terminals of the AND gates X2, X4, etc., and are connected to one input terminals of the AND gates X3, X5, etc. via NOT gates X11, X13, etc. Further, one input terminal of each of the AND gates X8 and X9 is connected with an ejection direction correction switch K.

Furthermore, a deflection amplitude controlling terminal B is a terminal for determining the amplitude of one deflection step. The deflection amplitude controlling terminal B determines the current values of the transistors M2, M7, etc., each serving as the constant current source for each CM circuit, and is connected to the respective gates of the transistors M2, M7, etc. The deflection amplitude can be made 0 as follows. That is, when this terminal is set to 0 V, the current of each current source becomes 0. Thus, no deflection current flows and the amplitude can be made 0. When this voltage is gradually increased, the current value gradually increases, thus allowing a large amount of deflection current to flow to thereby increase the deflection amplitude. That is, the deflection amplitude can be appropriately controlled on the basis of the voltage applied to this terminal.

Further, the source of the transistor M1 connected to the resistor Rh-B, and the sources of the transistors M2, M7, etc. each serving as the constant current source for each CM circuit, are connected to the ground (GND).

In the above-described configuration, each of the numerals "xN (N=1, 2, 4, or 50)" indicated by parentheses for the respective transistors M1 to M21 represents the parallel arrangement state of elements. For example, "x1" (transistors M12 to M21) indicates that the transistor has a standard element, whereas "x2" (transistors M7 to M11) indicates that the transistor has an element equivalent to two standard elements connected in parallel. In this manner, "xN" indicates that the transistor has an element equivalent to N standard elements connected in parallel.

Accordingly, since the transistors M2, M7, M12, and M17 are "x4", "x2", "x1", and "x1", respectively, when appropriate voltages are applied between the gates of these transistors and the ground, the drain currents thereof are in a ratio of 4:2:1:1.

Next, the operation of this circuit will be described. First, the description will focus solely on the CM circuit including the transistors M3, M4, M5, and M6.

The ejection execution inputting switch A becomes 1 (ON) only when liquid is to be ejected.

For instance, when A=1, B=2. 5V (applied voltage), C=1, and J3=1, the output of the XNOR gate X10 becomes 1. Thus, the output 1 and A=1 are input to the AND gate X2, so the output of the AND gate X2 becomes 1. The transistor M3 is thus turned ON.

Further, when the output of the XNOR gate X10 is 1, the output of the NOT gate X11 is 0, so the output 0 and A=1 are input to the AND gate X3. The output of the AND gate X3 thus becomes 0, and the transistor M5 is turned OFF.

Accordingly, the drains of the transistor M3 and M4 are connected to each other, and the drains of the transistors M6 and M5 are connected to each other. Thus, as described above, when the transistor M3 is ON and the transistor M5 is OFF, although a current flows from the transistor M4 to the transistor M3, no current flows from the transistor M6 to the transistor M5. Further, due to the characteristics of the CM circuit, when a current does not flow in the transistor M6, a current does not flow in the transistor M4, either. Further, since a voltage of 2.5 V is applied to the gate of the transistor M2, in the above-described case, from among the transistors M3, M4, M5, and M6, a corresponding current only flows from the transistor M3 to the transistor M2.

In this state, since the gate of the transistor M5 is turned OFF, a current does not flow in the transistor M6, and a current does not flow in the transistor M4 serving as the mirror, either. Although the same amount of current Ih should normally flow in the resistors Rh-A and Rh-B, in the state where the gate of the transistor M3 is turned ON, since the current determined by the transistor M2 is extracted from the midpoint between the resistors Rh-A and Rh-B via the transistor M3, the current value determined by the transistor M2 is added only with respect to the current flowing on the Rh-A side.

Therefore, $I_{Rh\text{-}A}>I_{Rh\text{-}B}$.

While the foregoing description is directed to the case where C=1, next, the case where C=0, that is, the case where the input of only the deflection direction selector switch C is made different (the inputs of the other switches A, B, and J3 are 1 just as described above) will be described in the following.

When C=0 and J3=1, the output of the XNOR gate X10 becomes 0. Since the input to the AND gate X2 thus becomes (0, 1 (A=1)), the output thereof becomes 0. The transistor M3 is thus turned OFF.

Further, when the output of the XNOR gate X10 becomes 0, the output of the NOT gate X11 becomes 1, so the input to the AND gate X3 becomes (1, 1 (A=1)), and the transistor M5 is turned ON.

When the transistor M5 is ON, a current flows in the transistor M6 and, due to this and the characteristics of the CM circuit, a current also flows in the transistor M4.

Thus, a current flows to each of the resistor Rh-A, the transistor M4, and the transistor M6 from the power source Vh. All of the current passed through the resistor Rh-A flows to the resistor Rh-B (since the transistor M3 is OFF, the current flowing out of the resistor Rh-A does not branch off to the transistor M3 side). Further, since the transistor M3 is OFF, all the current that has flown in the transistor M4 flows to the resistor Rh-B side. Furthermore, the current that has flown in the transistor M6 flows to the transistor M5.

As described above, when C=1, the current that has flown in the resistor Rh-A flows out while branching off to the resistor Rh-B side and the transistor M3 side; on the other hand, when C=0, in addition to the current that has flown in the resistor Rh-A, the current that has flown in the transistor M4 also flows to the resistor Rh-B. As a result, the currents flowing to the respective resistors Rh-A and Rh-B are in the following relationship: Rh-A<Rh-B. Further, the ratio at this time becomes symmetric between when C=1 and C=0.

In this way, by making the amounts of current respectively flowing to the resistor Rh-A and the resistor Rh-B different from each other, a difference can be established between the bubble generation times on the respective half-split heater elements 12. The ejection direction of liquid can be thus deflected.

Further, the deflection direction of liquid can be switched to symmetrical positions with respect to the arrangement direction of the nozzles 18 between when C=1 and C=0.

While the foregoing description is directed to the case where only the deflection control switch J3 is turned ON/OFF, when the deflection control switches J2 and J1 are further turned ON/OFF, the amounts of current supplied to the resistor Rh-A and the resistor Rh-B can be set more finely.

That is, while the current supplied to each of the transistors M4 and M6 can be controlled with the deflection control switch J3, the current supplied to each of the transistors M9 and M11 can be controlled with the deflection control switch J2. Furthermore, the current supplied to each of the transistors M14 and M16 can be controlled with the deflection control switch J1.

Further, as described above, drain currents are supplied to the respective transistors in the ratio of transistor M4 and transistor M6: transistor M9 and transistor M11: transistor M14 and transistor M16=4:2:1. Thus, using three bits of the deflection control switches J1 to J3, the deflection direction of liquid can be changed in the eight steps of (J1, J2, J3)=(0, 0, 0), (0, 0, 1), (0, 1, 0), (0, 1, 1), (1, 0, 0), (1, 0, 1), (1, 1, 0), and (1, 1, 1).

Further, since the amounts of current can be changed by changing the voltages applied between the ground and the gates of the transistors M2, M7, M12, and M17, the deflection amount per one step can be changed while keeping the ratio between the drain currents flowing in the respective transistors at 4:2:1.

Further, as described above, the deflection direction can be changed over to the symmetric positions with respect to the arrangement direction of the nozzles 18 by means of the deflection direction selector switch C.

In the line head 10, there are cases where the plurality of head chips 19 are arranged in the width direction of the recording medium and, as shown in FIG. 2, the head chips 19 are arranged in a so-called staggered array such that adjacent head chips 19 are opposed to each other (each head chip 19 is placed at a position 180 degrees rotated with respect to the adjacent head chip 19). In these cases, when a common signal is supplied from the deflection control switches J1 to J3 to two adjacent head chips 19, the deflection direction becomes opposite between the two adjacent head chips 19. In view of this, according to this embodiment, the deflection direction selector switch C is provided so that the deflection direction of each one head chip 19 as a whole can be switched symmetrically.

Accordingly, in the case where the plurality of head chips 19 are arranged in a so-called staggered array to form the line head, when, of the head chips 19, the head chips 19 (N, N+2, N+4, etc.) located at the even-numbered positions are set as C=0, and the head chips 19 (N+1, N+3, N+5, etc.) located at the odd-numbered positions are set as C=1, the deflection direction of each head chip 19 in the line head 10 can be made constant.

Further, while the ejection angle correction switches S and K are similar to the deflection control switches J1 to J3 in that these switches serve the purpose of deflecting the ejection direction of liquid, the ejection angle correction switches S and K are switches used for correcting the ejection angle of liquid.

First, the ejection angle correction switch K is a switch for determining whether or not to perform correction. The ejection angle correction switch K is set such that correction is performed when K=1, and correction is not performed when K=0.

Further, the ejection angle correction switch S is a switch for determining to which direction correction should be performed with respect to the arrangement direction of the nozzles 18.

For example, when K=0 (when no correction is performed), of the three inputs of the AND gates X8 and X9, one input becomes 0, so the outputs of the AND gates X8 and X9 both become 0. Thus, the transistors M18 and M20 are turned OFF, so the transistors M19 and M21 are also turned OFF. Accordingly, there is no change in the current flowing to each of the resistor Rh-A and Rh-B.

In contrast, when K=1, and S=0 and C=0, for example, the output of the XNOR gate X16 becomes 1. Thus, (1, 1, 1) is input to the AND gate X8, so the output thereof becomes 1 and the transistor M18 is turned ON. Further, since one input of the AND gate X9 is made to be 0 via the NOT gate X17, the output of the AND gate X9 becomes 0, and the transistor M20 is turned OFF. Accordingly, since the transistor M20 is OFF, a current does not flow in the transistor M21.

Further, due to the characteristics of the CM circuit, a current does not flow in the transistor M19, either. However, since the transistor M18 is ON, a current flows out from the midpoint between the resistor Rh-A and the resistor Rh-B, so that the current flows into the transistor M18. Therefore, the amount of current flowing in the resistor Rh-B can be made smaller than that in the resistor Rh-A. As a result, when correction is performed on the ejection direction of liquid, the impact position of liquid can be corrected by a predetermined amount with respect to the arrangement direction of the nozzles 18.

While in the above-described embodiment correction is performed by means of the two bits formed by the ejection angle correction switches S and K, finer correction can be performed by increasing the number of switches.

When the ejection direction of liquid is deflected by using the respective switches J1 to J3, S, and K, the current (deflection current Idef) can be represented as follows:

$$\begin{aligned} Idef &= J3 \times 4 \times Is + J2 \times 2 \times Is + J1 \times Is + S \times K \times Is \\ &= (4 \times J3 + 2 \times J2 + J1 + S \times K) \times Is. \end{aligned}$$

In Expression 1, +1 or −1 is given to J1, J2, and J3, +1 or −1 is given to S, and +1 or 0 is given to K.

As can be appreciated from Expression 1, the deflection current can be set in eight steps through the setting of the respective values of J1, J2, and J3, and correction can be performed on the basis of S and K independently from the settings of J1 to J3.

Further, since the deflection current can be set in four steps as positive values and in four steps as negative values, the deflection direction of liquid can be set in both directions with respect to the arrangement direction of the nozzles 18. For example, in FIG. 8, with respect to the perpendicular direction, the ejection direction can be deflected by θ to the left (the Z1 direction in FIG. 8), or can be deflected by θ to the right (the Z2 direction in FIG. 8). Further, the value of θ, that is, the amount of deflection can be arbitrarily set.

EXAMPLE

Next, an Example of the present invention will be described.

Figure 11:
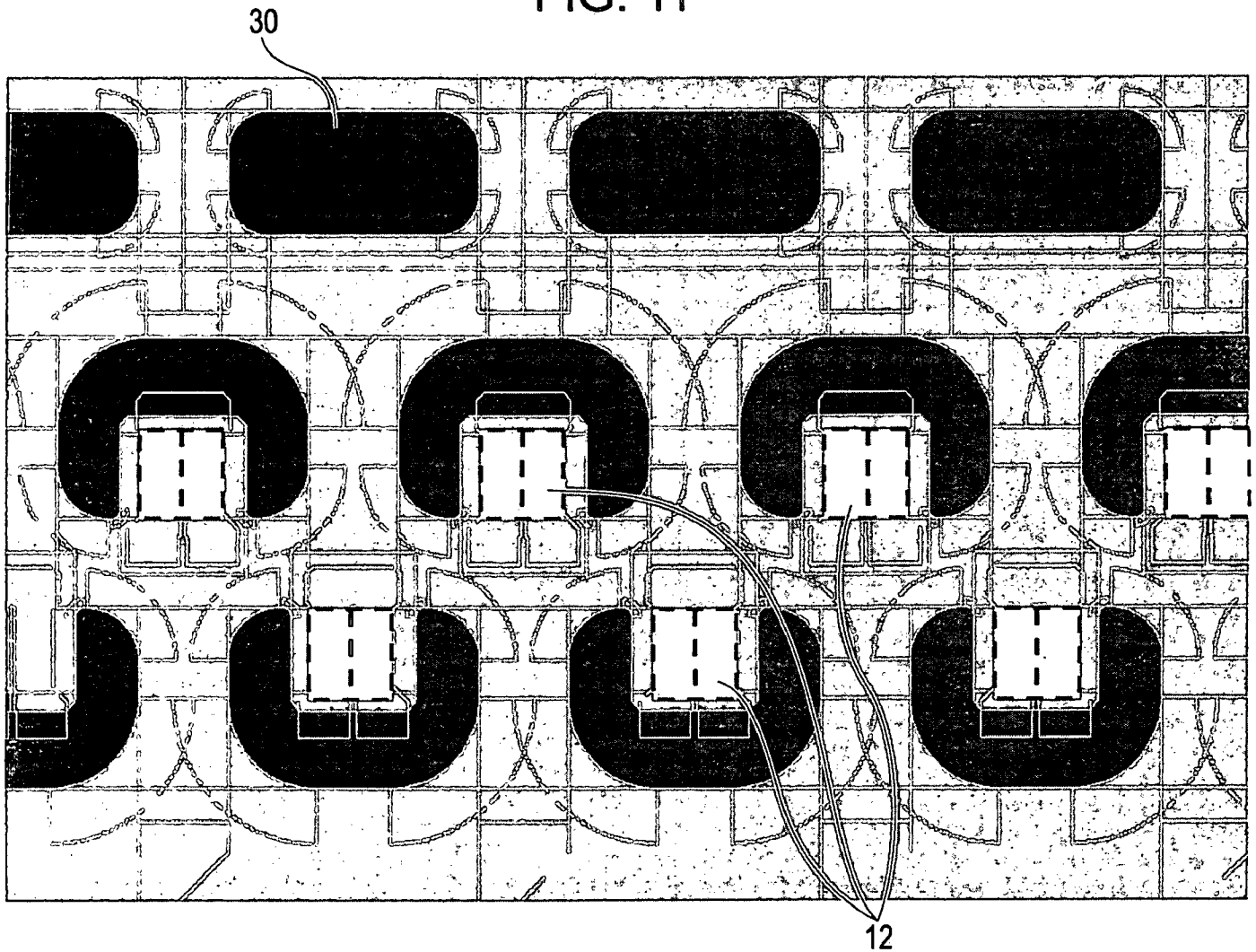
FIG. 11 is a diagram showing a part of the mask drawing of semiconductor processing according to an Example of the present invention.

FIG. 11 shows a part of the mask drawing of semiconductor processing according to this Example. In the example shown in FIG. 11, the liquid chambers 13*a* of the symmetrical configuration shown in FIG. 5 are provided, and square pole-like filters 30 are provided at a constant pitch of 2P so as to be opposed to the liquid chambers 13*a* on the lower side in FIG. 11. It should be noted that in FIG. 11, the upper side (the filter 30 side) represents the liquid supply side, and the lower side represents the barrier layer 13 side. In the mask drawing of FIG. 11, the positions of the heater elements 12 are also indicated by the dotted lines. The pitch P of the heater elements 12 is 42.3 (μm). That is, the heater elements 12 have a resolution of 600 DPI. Further, in FIG. 11, the center-to-center distance between the heater elements 12 in the perpendicular direction (interval corresponding to the interval δ in FIGS. 3 and 4) is also the same as the pitch P, at 42.3 (μm).

Figure 12:
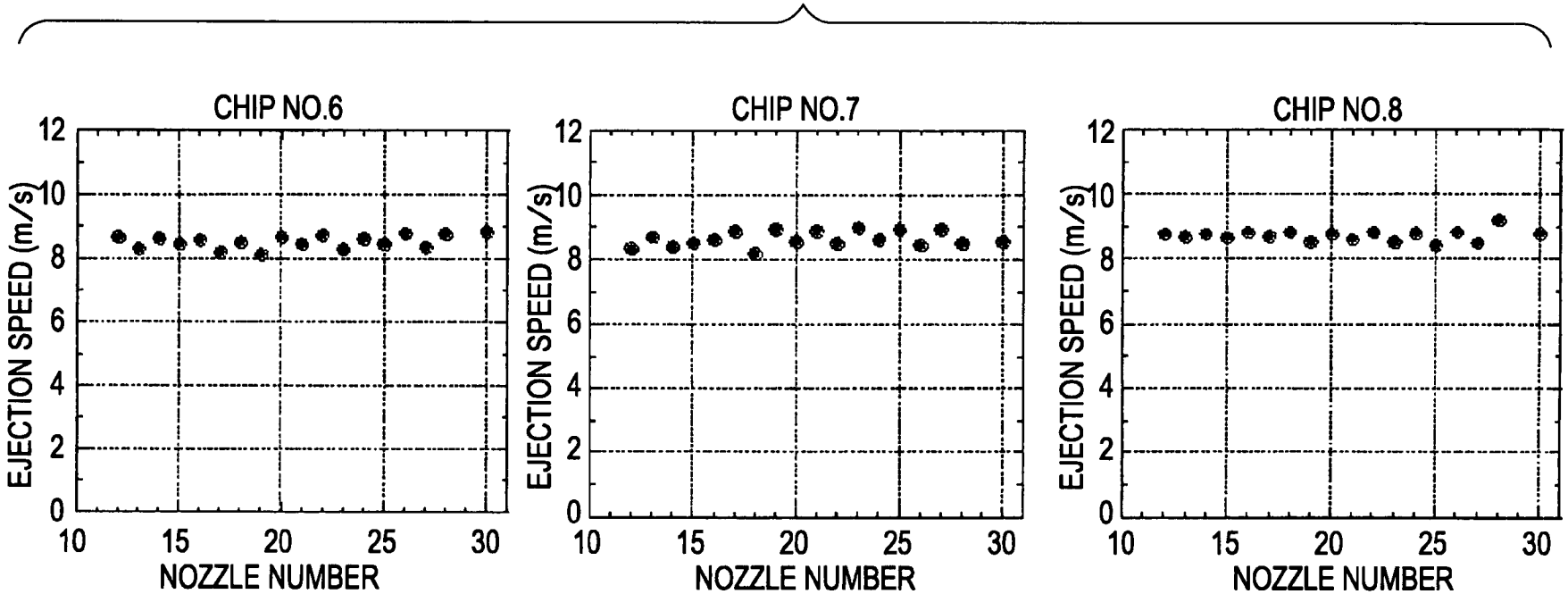
FIG. 12 is a diagram showing the results of measurement on ejection speed according to the Example.

Further, FIG. 12 is a graph showing the results of ejection speed measurement carried out with respect to eighteen nozzles 18 (liquid ejecting portions) in each of three consecutive head chips 19 (in this example, the chips Nos. 6, 7, and 8) in the line head 10 formed by sixteen head chips 19 per one color.

According to the results, the average speed was 8.64 (m/s), and the standard deviation was 0.21 (m/s), indicating a very small variation in ejection speed. This proves the stability of ejection according to this embodiment.

Further, as for the bubble generation rate, the following experiment was carried out.

Comparison was made between the arrangements in which the pitch P of the nozzles 18, and the average distance from the end of the head chip 19 to the arrangement position of the nozzles 18 are the same, and only the structure of the liquid chambers 13*a* is made different.

In this case, the bubble generation rate according to the related art was on the order of about 1 to $1.5\times10^{-5}$ per one ejection.

In contrast, in this embodiment, bubble generation was zero in a plurality of observation periods (ambient temperature: 25° C.). The ejection stability according to this embodiment was thus also proven by the measurement of bubble generation rate. Further, no image quality degradation due to bubble generation was observed upon actual recording onto an A4-size medium. A significant improvement in bubble generation rate was thus confirmed.

It should be understood by those skilled in the art that various modifications, combinations, sub-combinations and alterations may occur depending on design requirements and other factors insofar as they are within the scope of the appended claims or the equivalents thereof.

What is claimed is:

1. A liquid ejecting head comprising a plurality of liquid ejecting portions arrayed in a flat region on a substrate, the liquid ejecting portions each including:

a liquid chamber that accommodates liquid to be ejected;

a heater element arranged in the liquid chamber, the heater element generating bubbles in liquid in the liquid chamber when heated; and a nozzle for ejecting liquid in the liquid chamber in accordance with generation of bubbles by the heater element, wherein of a plurality of the heater elements, the center of the heater element located at the M-th position (M is either an odd number or even number) as counted from one end side is arranged on a straight line L1, which extends along an array direction of the heater element, or in its vicinity, and the center of the heater element located at the N-th position (N is an even number when the M is an odd number, and N is an odd number when the M is an even number) as counted from the one end side is arranged on a straight line L2 or in its vicinity, the straight line L2 being parallel to the straight line L1 and spaced at an interval δ (δ is a real number larger than 0) from the straight line L1, the liquid chamber is formed in a substantially recessed configuration in plan view so as to surround three sides of the heater element, a plurality of the heater elements are arrayed at a constant pitch P in the directions of the straight line L1 and the straight line L2, the liquid chamber that surrounds the heater element arranged on the straight line L1 or in its vicinity, and the liquid chamber that surrounds the heater element arranged on the straight line L2 or in its vicinity are arranged so that their opening portions are opposed to each other, a gap Wx (Wx is a real number larger than 0) is formed at least one of between the liquid chambers that are arrayed on the straight line L1 or in its vicinity and spaced from each other by a distance 2P, and between the liquid chambers that are arrayed on the straight line L2 or in its vicinity and spaced from each other by the distance 2P, with respect to an array direction of the liquid chamber, a gap Wy (Wy is a real number larger than 0, where Wy>Wx) is formed between the liquid chamber arrayed on the straight line L1 or in its vicinity, and the liquid chamber arrayed on the straight line L2 or in its vicinity, with respect to a direction perpendicular to the array direction of the liquid chamber, and a liquid channel having a width equal to the gap Wx, and a liquid channel having a width equal to the gap Wy are formed by the gap Wx and the gap Wy, respectively.

2. The liquid ejecting head according to claim 1, wherein:

the liquid channel having the width equal to the gap Wy is a channel formed in a zigzag configuration between the straight line L1 and the straight line L2.

3. The liquid ejecting head according to claim 2, wherein:

a wall in which the liquid channel having the width equal to the gap Wx is not formed and which forms one wall surface of the liquid channel having the width equal to the gap Wy between the liquid chambers that are formed on one of the straight line L1 and the straight line L2 and in its vicinity, has a chevron-shaped configuration that protrudes to the channel side.

4. The liquid ejecting head according to claim 1, further comprising election direction deflecting means for deflecting an election direction of liquid ejected from the nozzle of each of the liquid ejecting portions, to a plurality of directions with respect to an array direction of the liquid ejecting portions, wherein:

a plurality of the heater elements are provided side by side inside each one of the liquid chambers in the array direction of the liquid ejecting portions, the ejection direction deflecting means sets a difference between the amounts of current supplied to at least one and at least another one of the plurality of the heater elements inside each one of the liquid chambers, and controls the ejection direction of liquid ejected from the nozzle on the basis of the difference.

5. A liquid ejecting apparatus comprising a liquid ejecting head having a plurality of liquid ejecting portions arrayed in a flat region on a substrate, the liquid ejecting portions each including:

a liquid chamber that accommodates liquid to be ejected;

a heater element arranged in the liquid chamber, the heater element generating bubbles in liquid in the liquid chamber when heated; and a nozzle for ejecting liquid in the liquid chamber in accordance with generation of bubbles by the heater element, wherein of a plurality of the heater elements, the center of the heater element located at the M-th position (M is either an odd number or even number) as counted from one end side is arranged on a straight line L1, which extends along an array direction of the heater element, or in its vicinity, and the center of the heater element located at the N-th position (N is an even number when the M is an odd number, and N is an odd number when the M is an even number) as counted from the one end side is arranged on a straight line L2 or in its vicinity, the straight line L2 being parallel to the straight line L1 and spaced at an interval δ (δ is a real number larger than 0) from the straight line L1, the liquid chamber is formed in a substantially recessed configuration in plan view so as to surround three sides of the heater element, a plurality of the heater elements are arrayed at a constant pitch P in the directions of the straight line L1 and the straight line L2, the liquid chamber that surrounds the heater element arranged on the straight line L1 or in its vicinity, and the liquid chamber that surrounds the heater element arranged on the straight line L2 or in its vicinity are arranged so that their opening portions are opposed to each other, a gap Wx (Wx is a real number larger than 0) is formed at least one of between the liquid chambers that are arrayed on the straight line L1 or in its vicinity and spaced from each other by a distance 2P, and between the liquid chambers that are arrayed on the straight line L2 or in its vicinity and spaced from each other by the distance 2P, with respect to an array direction of the liquid chamber, a gap Wy (Wy is a real number larger than 0, where Wy>Wx) is formed between the liquid chamber arrayed on the straight line L1 or in its vicinity, and the liquid chamber arrayed on the straight line L2 or in its vicinity, with respect to a direction perpendicular to the array direction of the liquid chamber, and a liquid channel having a width equal to the gap Wx, and a liquid channel having a width equal to the gap Wy are formed by the gap Wx and the gap Wy, respectively.

6. The liquid ejecting apparatus according to claim 5, wherein:

the liquid channel having the width equal to the gap Wy is a channel formed in a zigzag configuration between the straight line L1 and the straight line L2.

7. The liquid ejecting apparatus according to claim 6, wherein:

a wall in which the liquid channel having the width equal to the gap Wx is not formed and which forms one wall surface of the liquid channel having the width equal to the gap Wy between the liquid chambers that are formed on one of the straight line L1 and the straight line L2 and in its vicinity, has a chevron-shaped configuration that protrudes to the channel side.

8. The liquid ejecting apparatus according to claim 5, further comprising ejection direction deflecting means for deflecting an ejection direction of liquid ejected from the nozzle of each of the liquid ejecting portions, to a plurality of directions with respect to an array direction of the liquid ejecting portions, wherein:

a plurality of the heater elements are provided side by side inside each one of the liquid chambers in the array direction of the liquid ejecting portions, the ejection direction deflecting means sets a difference between the amounts of current supplied to at least one and at least another one of the plurality of the heater elements inside each one of the liquid chambers, and controls the election direction of liquid ejected from the nozzle on the basis of the difference.

* * * * *